US011445782B2

(12) United States Patent
Baghdadi et al.

(10) Patent No.: US 11,445,782 B2
(45) **Date of Patent: *Sep. 20, 2022**

(54) ARTICLES OF FOOTWEAR, APPAREL, AND SPORTS EQUIPMENT WITH SOIL-SHEDDING PROPERTIES

(71) Applicant: NIKE, Inc., Beaverton, OR (US)

(72) Inventors: Hossein A. Baghdadi, Portland, OR (US); Caleb W. Dyer, Beaverton, OR (US); Eun Kyung Lee, Beaverton, OR (US); Myron Maurer, West Linn, OR (US); Denis Schiller, Vancouver, WA (US); Jeremy D. Walker, Portland, OR (US); Zachary C. Wright, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 564 days.

This patent is subject to a terminal disclaimer.

(21) Appl. No.: 16/523,133

(22) Filed: Jul. 26, 2019

(65) Prior Publication Data

US 2019/0343222 A1 Nov. 14, 2019

Related U.S. Application Data

(63) Continuation of application No. 15/506,046, filed as application No. PCT/US2015/047087 on Aug. 27, 2015, now Pat. No. 10,463,105.

(Continued)

(51) Int. Cl.

| | |
|---|---|
| ***A43B 13/04*** | (2006.01) |
| ***A43B 13/12*** | (2006.01) |

(Continued)

(52) U.S. Cl.

CPC ..... *A43B 13/122* (2013.01); *A41D 13/0015* (2013.01); *A41D 31/125* (2019.02);

(Continued)

(58) Field of Classification Search

CPC ..... A43B 1/04; A43B 13/04; A43B 13/12; A43B 13/122; A43B 13/22; A43B 13/223; A43B 23/0215; Y10T 428/24802

See application file for complete search history.

(56) References Cited

U.S. PATENT DOCUMENTS

| | | | |
|---|---|---|---|
| 2,920,983 | A | 1/1960 | Bugosh |
| 3,463,662 | A | 8/1969 | Hodes |

(Continued)

FOREIGN PATENT DOCUMENTS

| | | | |
|---|---|---|---|
| CN | 1471453 | A | 1/2004 |
| CN | 2627866 | Y | 7/2004 |

(Continued)

OTHER PUBLICATIONS

Blanco-Fuente et al. "Tanned Leather: a Good Model for Determining Hydrogels Bioadhesion", Int. J of Pharma., vol. 138, 1996, p. 103-112 (Year: 1996).

(Continued)

*Primary Examiner* — Gerard Higgins

(74) *Attorney, Agent, or Firm* — Thomas | Horstemeyer, LLP

(57) ABSTRACT

An article of footwear (100), apparel (500, 600), and/or sporting equipment (300, 400), and methods of manufacturing thereof, having a hydrogel present on at least a portion of an externally-facing side of the article. The hydrogel is effective in reducing soil accumulation on the article, and/or for reducing soil adhesion to the article.

20 Claims, 5 Drawing Sheets

Related U.S. Application Data

(60) Provisional application No. 62/198,872, filed on Jul. 30, 2015, provisional application No. 62/042,736, filed on Aug. 27, 2014, provisional application No. 62/042,750, filed on Aug. 27, 2014, provisional application No. 62/042,719, filed on Aug. 27, 2014.

(51) Int. Cl.

| | |
|---|---|
| ***A43B 1/04*** | (2022.01) |
| ***A43B 13/22*** | (2006.01) |
| ***A43B 23/02*** | (2006.01) |
| ***A43C 15/16*** | (2006.01) |
| ***A45F 3/04*** | (2006.01) |
| ***A41D 31/12*** | (2019.01) |
| ***A41D 13/00*** | (2006.01) |
| ***A43B 5/00*** | (2022.01) |
| ***A43B 5/02*** | (2006.01) |
| ***A43B 5/06*** | (2022.01) |
| ***A43B 5/14*** | (2006.01) |
| ***A43B 9/12*** | (2006.01) |
| ***A63B 55/00*** | (2015.01) |
| *A45C 3/00* | (2006.01) |

(52) U.S. Cl.

CPC ..... *A43B 1/04* (2013.01); *A43B 5/001* (2013.01); *A43B 5/02* (2013.01); *A43B 5/06* (2013.01); *A43B 5/14* (2013.01); *A43B 9/12* (2013.01); *A43B 13/04* (2013.01); *A43B 13/12* (2013.01); *A43B 13/22* (2013.01); *A43B 13/223* (2013.01); *A43B 23/0215* (2013.01); *A43C 15/16* (2013.01); *A43C 15/161* (2013.01); *A43C 15/165* (2013.01); *A43C 15/167* (2013.01); *A45F 3/04* (2013.01); *A63B 55/00* (2013.01); *A45C 3/001* (2013.01); *Y10T 428/24802* (2015.01)

(56) References Cited

U.S. PATENT DOCUMENTS

| | | | |
|---|---|---|---|
| 3,637,001 | A | 1/1972 | Roberts et al. |
| 4,118,354 | A | 10/1978 | Harada et al. |
| 4,271,608 | A | 6/1981 | Tomuro |
| 4,501,591 | A | 2/1985 | Ucci et al. |
| 4,520,138 | A | 5/1985 | Himes |
| 4,523,005 | A | 6/1985 | Szycher |
| 4,661,099 | A | 4/1987 | Von Bittera et al. |
| 4,773,408 | A | 9/1988 | Cilento |
| 4,924,608 | A | 5/1990 | Mogonye |
| 4,990,357 | A | 2/1991 | Karakelle et al. |
| 5,120,816 | A | 6/1992 | Gould et al. |
| 5,160,790 | A | 11/1992 | Elton |
| 5,314,478 | A | 5/1994 | Oka et al. |
| 5,480,377 | A | 1/1996 | Cartmell et al. |
| 5,576,072 | A | 11/1996 | Hostettler et al. |
| 5,591,779 | A | 1/1997 | Bleys et al. |
| 5,763,067 | A | 6/1998 | Bruggemann |
| 5,763,335 | A | 6/1998 | Hermann |
| 5,832,636 | A | 11/1998 | Lyden et al. |
| 5,943,792 | A | 8/1999 | Powell |
| 5,969,076 | A | 10/1999 | Lai et al. |
| 6,003,191 | A | 12/1999 | Sherry et al. |
| 6,011,104 | A | 1/2000 | Udy |
| 6,046,295 | A | 4/2000 | Frisch, Jr. et al. |
| 6,076,283 | A | 6/2000 | Boie |
| 6,112,380 | A | 9/2000 | Dolan et al. |
| 6,162,369 | A | 12/2000 | Allewaert et al. |
| 6,203,812 | B1 | 3/2001 | Ehrhard et al. |
| 6,335,392 | B1 | 1/2002 | Umezawa et al. |
| 6,367,167 | B1 | 4/2002 | Krstic et al. |
| 6,555,619 | B1 | 4/2003 | Kennedy et al. |
| 6,627,321 | B1 | 9/2003 | Ellingsen et al. |
| 6,698,110 | B1 | 3/2004 | Robbins |
| 6,782,642 | B2 | 8/2004 | Knoche et al. |
| 6,855,743 | B1 | 2/2005 | Gvozdic |
| 6,874,251 | B2 | 4/2005 | Moretti |
| 6,922,918 | B2 | 8/2005 | Issler |
| 6,948,264 | B1 | 9/2005 | Lyden |
| 6,949,271 | B2 | 9/2005 | Shannon et al. |
| 7,020,988 | B1 | 4/2006 | Holden et al. |
| 7,169,720 | B2 | 1/2007 | Etchells et al. |
| 7,373,739 | B2 | 5/2008 | Doerer et al. |
| 7,451,511 | B2 | 11/2008 | Ellis et al. |
| 7,451,557 | B2 | 11/2008 | McDonald et al. |
| 7,594,345 | B2 | 9/2009 | Fusco |
| 7,752,775 | B2 | 7/2010 | Lyden |
| 7,785,521 | B1 | 8/2010 | Chen |
| 7,814,687 | B2 | 10/2010 | Cook et al. |
| 7,832,120 | B2 | 11/2010 | Jung |
| 7,845,096 | B2 | 12/2010 | Ellis et al. |
| 7,854,076 | B2 | 12/2010 | Keppler et al. |
| 8,110,242 | B2 | 2/2012 | Hawkins et al. |
| 8,291,617 | B2 | 10/2012 | Halberstadt et al. |
| 8,303,977 | B2 | 11/2012 | Kuzma et al. |
| 8,609,766 | B2 | 12/2013 | Bette |
| 8,791,200 | B2 | 7/2014 | Kocher et al. |
| 8,796,394 | B2 | 8/2014 | Messersmith et al. |
| 8,853,289 | B2 | 10/2014 | Smith et al. |
| 8,906,497 | B2 | 12/2014 | Marchgraber et al. |
| 9,139,684 | B2 | 9/2015 | Coneski et al. |
| 9,206,114 | B1 | 12/2015 | Coneski et al. |
| 9,392,841 | B2 | 7/2016 | Walker et al. |
| 9,456,654 | B2 | 10/2016 | Dyer et al. |
| 10,051,913 | B2 | 8/2018 | Dyer et al. |
| 10,064,447 | B2 | 9/2018 | Wright et al. |
| 10,070,685 | B2 | 9/2018 | Walker et al. |
| 10,076,154 | B2 | 9/2018 | Walker et al. |
| 10,076,155 | B2 | 9/2018 | Dyer et al. |
| 10,076,156 | B2 | 9/2018 | Dyer et al. |
| 10,076,157 | B2 | 9/2018 | Wright et al. |
| 10,076,158 | B2 | 9/2018 | Wright et al. |
| 10,085,513 | B2 | 10/2018 | Dyer et al. |
| 10,092,062 | B2 | 10/2018 | Wright et al. |
| 10,130,140 | B2 | 11/2018 | Dyer et al. |
| 10,362,834 | B2 | 7/2019 | Baghdadi et al. |
| 10,463,105 | B2 * | 11/2019 | Baghdadi ..... A63B 55/00 |
| 10,531,705 | B2 | 1/2020 | Baghdadi et al. |
| 2001/0014707 | A1 | 8/2001 | Thomas et al. |
| 2001/0053897 | A1 | 12/2001 | Frate et al. |
| 2002/0116843 | A1 | 8/2002 | Harrison |
| 2002/0152638 | A1 | 10/2002 | Safdeye et al. |
| 2002/0188057 | A1 | 12/2002 | Chen |
| 2003/0074718 | A1 | 4/2003 | English |
| 2003/0213148 | A1 | 11/2003 | Knowles |
| 2003/0226283 | A1 | 12/2003 | Braunschweiler |
| 2004/0020080 | A1 | 2/2004 | Cox et al. |
| 2004/0143180 | A1 | 7/2004 | Zhong et al. |
| 2004/0147188 | A1 | 7/2004 | Johnson et al. |
| 2004/0255362 | A1 | 12/2004 | Soerens et al. |
| 2005/0075027 | A1 | 4/2005 | Etchells et al. |
| 2005/0288440 | A1 | 12/2005 | Chou et al. |
| 2006/0035030 | A1 | 2/2006 | Shannon et al. |
| 2006/0141186 | A1 | 6/2006 | Janssen et al. |
| 2007/0017124 | A1 | 1/2007 | Koo et al. |
| 2007/0124960 | A1 | 6/2007 | Friedman |
| 2007/0141306 | A1 | 6/2007 | Kasai et al. |
| 2008/0120869 | A1 | 5/2008 | Roy et al. |
| 2008/0155857 | A1 | 7/2008 | Rosen |
| 2008/0229612 | A1 | 9/2008 | Sommer et al. |
| 2008/0241371 | A1 | 10/2008 | Havelka et al. |
| 2008/0314287 | A1 | 12/2008 | Clark et al. |
| 2009/0061744 | A1 | 3/2009 | Bajaj |
| 2009/0084477 | A1 | 4/2009 | Sandstrom et al. |
| 2009/0090031 | A1 | 4/2009 | Jung |
| 2009/0234039 | A1 | 9/2009 | Schuette et al. |
| 2009/0313855 | A1 | 12/2009 | Skirrow |
| 2010/0032357 | A1 | 2/2010 | Kiyomoto et al. |
| 2010/0048752 | A1 | 2/2010 | Vignola et al. |
| 2010/0083534 | A1 | 4/2010 | Howlett |
| 2010/0109200 | A1 | 5/2010 | Cox et al. |
| 2010/0113733 | A1 | 5/2010 | Cox et al. |

(56) References Cited

U.S. PATENT DOCUMENTS

| | | | |
|---|---|---|---|
| 2010/0146824 | A1 | 6/2010 | Sensini |
| 2010/0154253 | A1 | 6/2010 | Imazato et al. |
| 2010/0215707 | A1 | 8/2010 | McDonald et al. |
| 2010/0323573 | A1 | 12/2010 | Chu et al. |
| 2011/0008612 | A1 | 1/2011 | Lee |
| 2011/0112236 | A1 | 5/2011 | Ding |
| 2011/0287929 | A1 | 11/2011 | Smith et al. |
| 2012/0088602 | A1 | 4/2012 | Morken |
| 2012/0148778 | A1 | 6/2012 | Dawkins |
| 2012/0151805 | A1 | 6/2012 | Polegato Moretti |
| 2012/0210608 | A1 | 8/2012 | Baker et al. |
| 2012/0216423 | A1 | 8/2012 | Lyden |
| 2012/0216424 | A1 | 8/2012 | Lyden |
| 2012/0260535 | A1 | 10/2012 | Tsang |
| 2012/0312192 | A1 | 12/2012 | Detty et al. |
| 2013/0109804 | A1 | 5/2013 | Kusaka et al. |
| 2013/0255103 | A1 | 10/2013 | Dua et al. |
| 2013/0260104 | A1 | 10/2013 | Dua et al. |
| 2013/0260629 | A1 | 10/2013 | Dua et al. |
| 2013/0340295 | A1 | 12/2013 | Adami et al. |
| 2014/0024768 | A1 | 1/2014 | Coneski et al. |
| 2014/0075791 | A1 | 3/2014 | Smith et al. |
| 2014/0217636 | A1 | 8/2014 | Skaja et al. |
| 2015/0141539 | A1 | 5/2015 | Lee |
| 2015/0307745 | A1 | 10/2015 | Popa et al. |
| 2015/0353474 | A1 | 12/2015 | Coneski et al. |
| 2015/0353741 | A1 | 12/2015 | Liao |
| 2016/0058107 | A1 | 3/2016 | Walker et al. |
| 2016/0058108 | A1 | 3/2016 | Schiller et al. |
| 2016/0058109 | A1 | 3/2016 | Schiller et al. |
| 2016/0058110 | A1 | 3/2016 | Dyer et al. |
| 2016/0058111 | A1 | 3/2016 | Wright et al. |
| 2016/0058112 | A1 | 3/2016 | Dyer et al. |
| 2016/0058113 | A1 | 3/2016 | Wright et al. |
| 2016/0058114 | A1 | 3/2016 | Walker et al. |
| 2016/0058115 | A1 | 3/2016 | Dyer et al. |
| 2016/0058116 | A1 | 3/2016 | Wright et al. |
| 2016/0058117 | A1 | 3/2016 | Wright et al. |
| 2016/0058119 | A1 | 3/2016 | Dyer et al. |
| 2016/0136912 | A1 | 5/2016 | Le et al. |
| 2016/0192735 | A1 | 7/2016 | Dyer et al. |
| 2016/0192736 | A1 | 7/2016 | Dyer et al. |
| 2016/0286905 | A1 | 10/2016 | Schiller |
| 2016/0295959 | A1 | 10/2016 | Dyer et al. |
| 2017/0238653 | A1 | 8/2017 | Baghdadi et al. |

FOREIGN PATENT DOCUMENTS

| | | | |
|---|---|---|---|
| CN | 1890097 | | 1/2007 |
| CN | 201157028 | Y | 12/2008 |
| CN | 201360601 | Y | 12/2009 |
| CN | 201445011 | U | 5/2010 |
| CN | 101801601 | A | 8/2010 |
| CN | 101873812 | | 10/2010 |
| CN | 101953525 | A | 1/2011 |
| CN | 101953534 | A | 1/2011 |
| CN | 102038315 | A | 5/2011 |
| CN | 102250407 | A | 11/2011 |
| CN | 102595949 | A | 7/2012 |
| CN | 103357062 | A | 10/2013 |
| CN | 103757744 | A | 4/2014 |
| CN | 203952576 | U | 11/2014 |
| CN | 104549961 | A | 4/2015 |
| DE | 4138941 | A1 | 6/1993 |
| DE | 4211302 | A1 | 10/1993 |
| DE | 4308347 | A1 | 9/1994 |
| DE | 4406219 | A1 | 8/1995 |
| DE | 29602823 | U1 | 4/1996 |
| DE | 19955839 | C1 | 3/2001 |
| DE | 10116757 | A1 | 10/2002 |
| DE | 102013221204 | | 4/2015 |
| EP | 0335669 | A2 | 10/1989 |
| EP | 0894814 | A1 | 2/1999 |
| EP | 1894482 | A2 | 3/2008 |
| EP | 2030517 | A1 | 3/2009 |
| EP | 2292113 | A2 | 3/2011 |
| EP | 2462908 | A1 | 6/2012 |
| GB | 2313537 | A | 12/1997 |
| GB | 2415908 | A | 1/2006 |
| JP | 2715088 | B2 | 2/1989 |
| JP | H06253905 | | 9/1994 |
| JP | H08258511 | | 10/1996 |
| JP | H105005 | | 1/1998 |
| JP | 2000166609 | A | 6/2000 |
| JP | 2000178877 | A | 6/2000 |
| JP | 2000308501 | A | 11/2000 |
| JP | 2002325601 | A | 11/2002 |
| JP | 2004292962 | A | 10/2004 |
| JP | 2005111691 | A | 4/2005 |
| JP | 2008260889 | A | 10/2008 |
| JP | 2010099332 | A | 5/2010 |
| JP | 4864227 | B2 | 2/2012 |
| KR | 100750324 | B1 | 8/2007 |
| KR | 20090124313 | A | 12/2009 |
| KR | 20120124616 | A | 11/2012 |
| KR | 101232846 | B1 | 2/2013 |
| TW | 377281 | B | 12/1999 |
| TW | 201002788 | A | 1/2010 |
| TW | I478992 | B | 4/2015 |
| WO | 9631555 | A2 | 10/1996 |
| WO | 9712648 | A1 | 4/1997 |
| WO | 0043449 | | 7/2000 |
| WO | 0043449 | A1 | 7/2000 |
| WO | 03086232 | A2 | 10/2003 |
| WO | WO 2005/000061 | A1 | 1/2005 |
| WO | WO 2006/015325 | A1 | 2/2006 |
| WO | 2006066752 | A1 | 6/2006 |
| WO | 2007046806 | A1 | 4/2007 |
| WO | WO 2007/090245 | A1 | 8/2007 |
| WO | WO 2007/135069 | A1 | 11/2007 |
| WO | 2009146441 | A1 | 12/2009 |
| WO | 2010011434 | A1 | 1/2010 |
| WO | WO 2013/106658 | A1 | 7/2013 |
| WO | 2014025161 | | 2/2014 |
| WO | 2014126643 | A1 | 8/2014 |

OTHER PUBLICATIONS

Dyson, R.W. "Specialty Polymers" Blackie & Son Ltd. (1987).
Retrieved from the Internet: URL:https://en.wikipedia.org/wiki/Gel#Hydrogels [retrieved on Aug. 24, 2016].
Traubel, H. "New Materials Permeable to Water Vapor" Springer; DOI: 10.1007/978-3-642-59978-1.
Lubrizol Estane® MVT 70AT3 Thermoplastic Polyurethane, Moisture Vapor Transmission.
U.S. Appl. No. 14/814,214, filed Jul. 30, 2015, Notice of Allowance dated Aug. 10, 2016.
U.S. Appl. No. 14/814,219, filed Jul. 30, 2015, Notice of Allowance dated Mar. 31, 2016.
Paleos, "What are Hydrogels?", 2012, p. 1-4, acquired from http://pittsburghplastics.com/assets/files/What%20Are%v 20Hydrogels.pdf.
Alf et al., Chemical vapor deposition of conformal, functional, and responsive polymer films, Adv. Mater., 22(18):1993-2027 (2010).
Arkema, Pebax® Polyether Block Amides brochure, applicant's internal files Jun. 22, 2015.
Chen et al., An new avenue to nonfouling materials, Adv. Mater., 20(2):335-8 (2008).
Garcia, M.A., "Patent Picks: Marine Coating Technologies," *Chemical & Engineering News,* 94(4):34 (Jan. 25, 2016).
International Search Report and Written Opinion for International Application No. PCT/US2015/047082, dated Nov. 26, 2015 (15 pages).
International Search Report and Written Opinion for International Application No. PCT/US2015/047083, dated Nov. 26, 2015 (15 pages).
International Search Report and Written Opinion for International Application No. PCT/US2015/047084, dated Nov. 27, 2015 (16 pages).
International Search Report and Written Opinion for International Application No. PCT/US2015/047086, dated Nov. 26, 2015 (15 pages).

(56) References Cited

OTHER PUBLICATIONS

International Search Report and Written Opinion for International Application No. PCT/US2015/047087, dated Dec. 8, 2015 (15 pages).
Invitation to Pay Additional Fees and Communication Relating to the Results of the Partial International Search for International Application No. PCT/US2015/047081, dated Nov. 26, 2015 (5 pages).
Jiang et al., Ultralow-fouling, functionalizable, and hydrolyzable zwitterionic materials and their derivatives for biological applications, Adv. Mater., 22(9):920-32 (2010).
Lee et al., Mechanical properties of amphiphilic urethane acrylate ionomer hydrogels having heterophasic gel structure, Coll. Polymer Sci., 277(2-3):265-9 (1999).
Lubrizol Corporation, "Medical Device Solutions," Brochure (2014).
Lubrizol Corporation, "Tecophilic Extrusion Grade," Technical Data Sheet (2013).
Lubrizol Corporation, "Tecophilic Hydrogel," Technical Data Sheet (2013).
Lubrizol Corporation, "Tecophilic Solution Grade," Technical Data Sheet (2013).
Lubrizol Corporation, Your Link To: Advanced Wound Care brochure (Sep. 2013).
Salerno-Kochan et al., "Materials Used in Functional Outerwear—Characteristics and Customer Preferences," in Science in Research and Practice, pp. 159-167 (Eds. Chochot Andrzej, Sep. 2014).
Search Report for related GB Application No. 1515179.8, dated Mar. 22, 2016 (4 pages).
Shao et al., Difference in hydration between carboxybetaine and sulfobetained, J. Phys. Chem. B, 114(49):16625-31 (2010).
Wikipedia: "Glass transition," XP002751026, retrieved on Dec. 4, 2015, from https://en.wikipedia.org/wiki/Glass_transition, modified Oct. 3, 2015 (11 pages).
Written Opinion of the International Searching Authority for related International Application No. PCT/US2015/047081, dated Mar. 22, 2016 (7 pages).
Yang et al., The effect of lightly crosslinked poly(carboxybetained) hydrogel coating on the performance of sensors in whole blood, Biomaterials, 33:7945-51 (2012).
Zwitter Technology: a new technology platform for biofouling control, Seattle, Washington, Jan. 10, 2014.

* cited by examiner

ARTICLES OF FOOTWEAR, APPAREL, AND SPORTS EQUIPMENT WITH SOIL-SHEDDING PROPERTIES

CROSS-REFERENCE TO RELATED APPLICATIONS

This application is a continuation of, and claims priority to, U.S. Patent Application entitled "ARTICLES OF FOOTWEAR, APPAREL, AND SPORTS EQUIPMENT WITH SOIL-SHEDDING PROPERTIES," filed on Feb. 23, 2017, and assigned application Ser. No. 15/506,046, which is the 35 U.S.C. § 371 national stage application of PCT Application entitled "ARTICLES OF FOOTWEAR, APPAREL, AND SPORTS EQUIPMENT WITH WATER ABSORBTION PROPERTIES", filed on Aug. 27, 2015, and assigned application number PCT/US2015/047087, which claims priority to U.S. Patent Provisional Application entitled "ARTICLES OF FOOTWEAR, APPAREL, AND SPORTS EQUIPMENT WITH WATER ABSORBTION PROPERTIES", filed on Jul. 30, 2015, and assigned application No. 62/198,872, U.S. Patent Provisional Application entitled "OUTSOLES WITH ABSORPTIVE THERMOPLASTIC POLYURETHANES", filed on Aug. 27, 2014, and assigned application No. 62/042,736, U.S. Patent Provisional Application entitled "WATER-ABSORBING COMPOSITIONS FOR OUTSOLES", filed on Aug. 27, 2014, and assigned application No. 62/042,719, and U.S. Patent Provisional Application entitled "OUTSOLES WITH ABSORPTIVE POLYAMIDES", filed on Aug. 27, 2014, and assigned application No. 62/042,750, all of which are herein incorporated by reference in their entireties.

FIELD

The present disclosure relates to articles of footwear, articles of apparel, and articles of sporting equipment. In particular, the present disclosure is directed to the uppers of articles of footwear, components of articles of apparel, and components of sporting equipment which are used in conditions conducive the accumulation of soil on the articles.

BACKGROUND

Articles of footwear of various types, articles of apparel of various types, and articles of sporting equipment of various types are frequently used for a variety of activities including outdoor activities, military use, and competitive sports. The articles frequently contact the ground and/or have soil contact them during use and thus often accumulate soil (e.g., inorganic materials such as mud, dirt, and gravel, organic material such as grass, turf, and excrement, and combinations of inorganic and organic materials) on their externally-facing surfaces when the articles are used under conditions where soil is present.

For example, when articles of footwear are used on unpaved surfaces, both the outsoles and the uppers of the footwear (i.e., the portion of the footwear above the outsole and midsole when a midsole is present) can accumulate soil. The soil on the outsoles can accumulate from the article directly contacting the ground, while soil may be splattered on the upper portion of the footwear during wear.

Similarly, when articles of apparel (e.g., shirts, pants, socks and the like) are worn on unpaved surfaces, the apparel can directly contact the unpaved surface and accumulate soil (e.g., when a baseball player slides into a base) or soil can be splattered onto the apparel during use (e.g., mud can splash onto socks or running pants when running on a muddy surface). Additionally, articles of sporting equipment can directly contact unpaved surfaces during use (e.g., the bottom of a golf club bag may be set directly on the ground while playing golf), or soil can splatter on the articles during use (e.g., mud can splash onto a backpack while hiking).

BRIEF DESCRIPTION OF THE DRAWINGS

For a more complete understanding of the disclosure, reference should be made to the following detailed description and accompanying drawings wherein.

Figure 1:
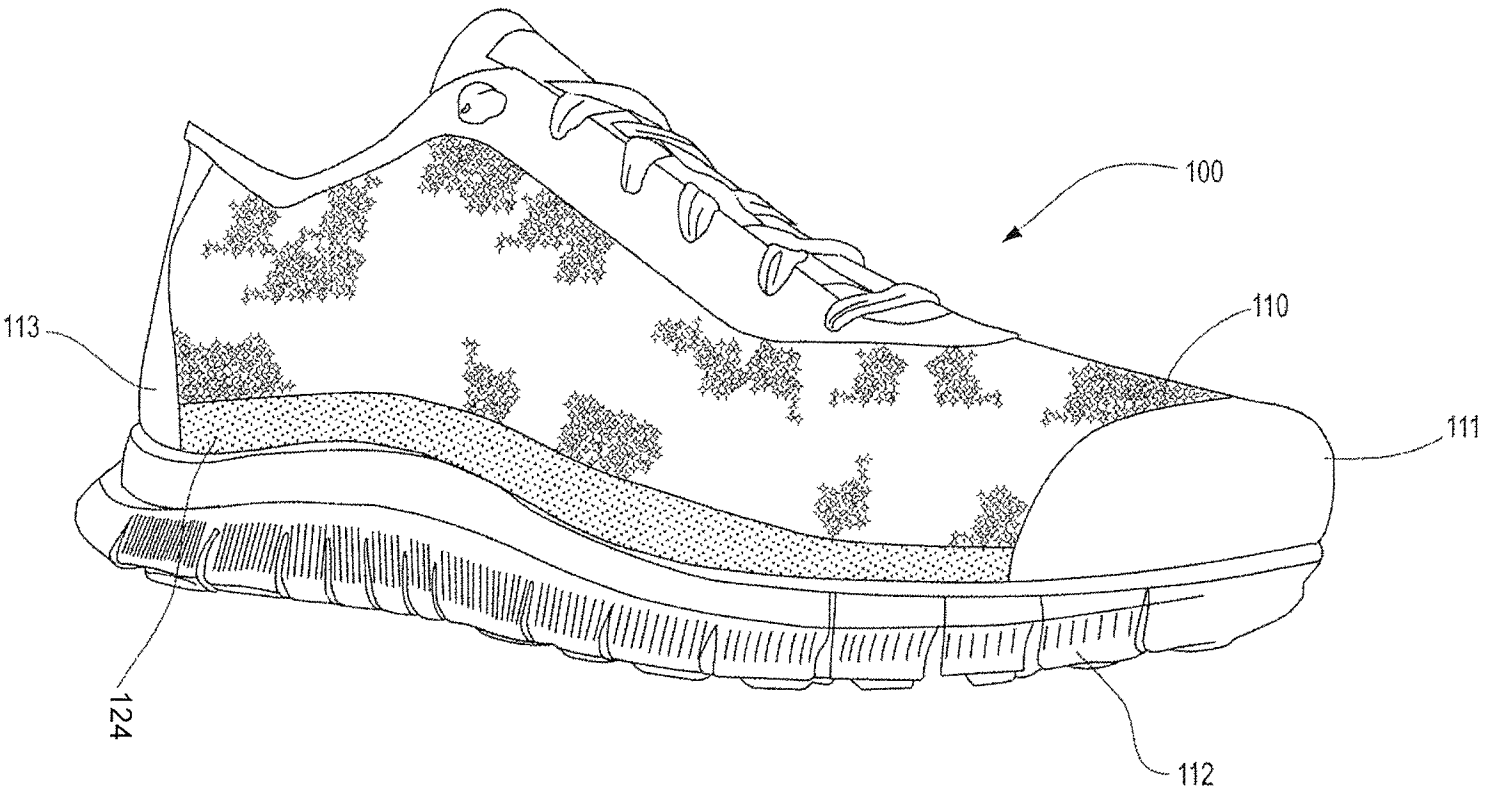
FIG. 1 is a perspective view of an article of footwear in an aspect of the present disclosure having an upper including a material (e.g., a film) in accordance with the present disclosure.

The articles of footwear shown in the figures are illustrated for use with a user's right foot. However, it is understood that the following discussion applies correspondingly to left-footed articles of footwear as well.

DESCRIPTION

It has now been discovered that particular materials comprising a hydrogel when disposed on an externally-facing surface of an article of footwear, apparel or sporting equipment can be effective at preventing or reducing the accumulation of soil on the article during wear on unpaved surfaces. Additionally, it has been found that the selection of certain materials, in terms of their physical characteristics as measured using the test methods described herein, is useful to achieve specific performance benefits for the articles as disclosed herein. Accordingly, the present disclosure describes components of articles of footwear, apparel or sporting equipment formed of these materials which include a hydrogel, articles of footwear, apparel or sporting equipment made using these articles, use of these materials in articles of footwear, apparel or sporting equipment, as well as methods of manufacturing and using the articles of footwear, apparel or sporting equipment. The material which includes the hydrogel defines at least a portion of a surface or side of the articles. In other words, the material is present at or forms the whole of or part of an outer surface of the article. When the article is included in an article of footwear, apparel or sporting equipment, the material defines at least a portion of an exterior surface of the article or a side of the article which is externally-facing.

As can be appreciated, preventing or reducing soil accumulation on articles of footwear, apparel and sporting equipment can provide many benefits. Preventing or reducing soil accumulation on articles during wear on unpaved surfaces also can significantly affect the weight of accumulated soil adhered to the article during wear, reducing fatigue to the wearer caused by the adhered soil. Preventing or reducing soil accumulation on the article can help preserve traction during wear. For example, preventing or reducing soil accumulation on the article can improve or preserve the performance of traction elements present on the article during wear on unpaved surfaces. When worn while playing sports, preventing or reducing soil accumulation on articles can improve or preserve the ability of the wearer to manipulate sporting equipment such as a ball with the article of the article of footwear. Further, preventing or reducing soil accumulation on the article can make it easier to clean the article following use.

In a first aspect, the present disclosure is directed to a component for an article of footwear, apparel or sporting equipment. The component can be a component comprising a first side; and an opposing second side; wherein the first side comprises a material, and the material compositionally comprises a hydrogel. The component can be a component comprising a first surface configured to be externally-facing such as when the component is present in a finished article; and a second surface of the component opposing the first surface. At least a portion of the first surface of the component comprises a material defining at least a portion of the first surface, and the material compositionally comprises a hydrogel. In other words, a hydrogel material is present at and defines at least a portion of the first surface or first side of the component. The component can be configured to be secured to a second component as part of an article of footwear, apparel or sporting equipment. The component can be a component which prevents or reduces soil accumulation such that the component retains at least 10% less soil by weight as compared to a second component which is identical to the component except that the second component is substantially free of the material comprising a hydrogel.

In accordance with the present disclosure, the hydrogel-containing material of the component (and thus the portion of the component which includes the material) can be a material which can be characterized based on its ability to take up water. The material can be a material which has a water uptake capacity at 24 hours of greater than 40% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure as described below. Additionally or alternatively, the material can have a water uptake capacity at 1 hour of greater than 100% by weight. The material can have a water uptake rate of greater than 20 $g/(m^2 \times min^{0.5})$, as characterized by the Water Uptake Rate Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure. The material can have a water uptake rate of greater than 100 $g/(m^2 \times min^{0.5})$. The material can be a material which has both a water uptake capacity at 24 hours of greater than 40% by weight, and a water uptake rate of greater than 20 $g/(m^2 \times min^{0.5})$. The material can have a swell thickness increase at 1 hour greater than 20%, as characterize by the Swelling Capacity Test with the Footwear Sampling Procedure, the Apparel Sampling Procedure, the Equipment Sampling Procedure, the Co-extruded Film Sampling Procedure, or the Neat Film Sampling Procedure. The material can be a material which has both a water uptake capacity at 24 hours of greater than 40% by weight, and a swell thickness increase at 1 hour greater than 20%.

Additionally, the hydrogel-containing material of the present disclosure can be characterized based on its surface properties. The material can be a material wherein the at least a portion of the first surface defined by the material has a wet-state contact angle less than 80°, as characterized by the Contact Angle Test with the Footwear Sampling Procedure, the Apparel Sampling Procedure, the Equipment Sampling Procedure, the Co-extruded Film Sampling Procedure, or the Neat Film Sampling Procedure; and wherein the material which has a water uptake capacity at 24 hours of greater than 40% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure. The material can be a material wherein the at least a portion of the first surface defined by the material has a wet-state coefficient of friction less than 0.8, as characterized by the Coefficient of Friction Test with the Footwear Sampling Procedure, the Apparel Sampling Procedure, the Equipment Sampling Procedure, the Co-extruded Film Sampling Procedure, or the Neat Film Sampling Procedure; and wherein the material has a water uptake capacity at 24 hours of greater than 40% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure.

The material can be a material wherein the at least a portion of the first surface defined by the material has a wet-state contact angle less than 80°, as characterized by the Contact Angle Test with the Footwear Sampling Procedure, the Apparel Sampling Procedure, the Equipment Sampling Procedure, the Co-extruded Film Sampling Procedure, or the Neat Film Sampling Procedure; and wherein the material which has a water uptake capacity at 1 hour of greater than 100% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure. The material can be a material wherein the at least a portion of the first surface defined by the material has a wet-state coefficient of friction less than 0.8, as characterized by the Coefficient of Friction Test with the Footwear Sampling Procedure, the Apparel Sampling Procedure, the Equipment Sampling Procedure, the Co-extruded Film Sampling Procedure, or the Neat Film Sampling Procedure; and wherein the material has a water uptake capacity at 1 hour of greater than 100% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure.

Further, the hydrogel-containing material of the present disclosure can be characterized based on changes in properties between its dry state and its wet state. The material can be a material which has a wet-state glass transition temperature when equilibrated at 90% relative humidity and a dry-state glass transition temperature when equilibrated at 0% relative humidity, each as characterized by the Glass Transition Temperature Test with the Neat Material Sampling Process, wherein the wet-state glass transition temperature is more than 6° C. less than the dry-state glass transition temperature; and wherein the material preferably also has a water uptake capacity at 24 hours of greater than 40% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure. The material can have a wet-state storage modulus when equilibrated at 90% relative humidity and a dry-state storage modulus when equilibrated at 0% relative humidity, each as characterized by the Storage Modulus Test with the Neat Material Sampling Procedure, wherein the wet-state storage modulus is less than the dry-state storage modulus of the material; and wherein the material preferably also has a water uptake capacity at 24 hours of greater than 40% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure.

The material can be a material which has a wet-state glass transition temperature when equilibrated at 90% relative humidity and a dry-state glass transition temperature when equilibrated at 0% relative humidity, each as characterized by the Glass Transition Temperature Test with the Neat Material Sampling Process, wherein the wet-state glass transition temperature is more than 6° C. less than the dry-state glass transition temperature; and wherein the material preferably also has a water uptake capacity at 1 hour of greater than 100% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure. The material can have a wet-state storage modulus when equilibrated at 90% relative humidity and a dry-state storage modulus when equilibrated at 0% relative humidity, each as characterized by the Storage Modulus Test with the Neat Material Sampling Procedure, wherein the wet-state storage modulus is less than the dry-state storage modulus of the material; and wherein the material preferably also has a water uptake capacity at 1 hour of greater than 100% by weight, as characterized by the Water Uptake Capacity Test with the Footwear Sampling Procedure, the Apparel Sampling Procedure, the Equipment Sampling Procedure, the Co-extruded Film Sampling Procedure, the Neat Film Sampling Procedure, or the Neat Material Sampling Procedure.

The material of the present disclosure can also or alternatively be characterized based on the type of hydrogel which it includes. In some examples, the hydrogel of the material can comprise or consist essentially of a thermoplastic hydrogel. The hydrogel of the material can comprise or consist essentially of one or more polymers selected from a polyurethane, a polyamide homopolymer, a polyamide copolymer, and combinations thereof. For example, the polyamide copolymer can comprise or consist essentially of a polyamide block copolymer.

The components of the present disclosure can also or alternatively be characterized based on their structure such as, for example, the thickness of the material on the externally-facing surface, how the material is arranged on the component, whether or not traction elements are present, whether or not the material is affixed to a backing material, and the like. The component can be a component having the material present on at least 80% of the externally-facing surface of the component. The hydrogel-containing material of the component can have a dry-state thickness ranging from 0.1 millimeters to 2 millimeters. The component can comprise one or more fraction elements present on its first surface, or can comprise a traction element.

In a second aspect, the present disclosure is directed to an article of footwear, apparel or sporting equipment comprising a component as disclosed herein. The article can be an article wherein the article has a first, externally-facing surface and a second surface opposing the first surface, wherein a material comprising a hydrogel defines at least a portion of the externally-facing first surface of the article. The material can be a material as described above, e.g. with respect to the first aspect of the disclosure. The article can be an article which prevents or reduces soil accumulation such that the article retains at least 10% less soil by weight as compared to a second article which is identical to the article except that the second article is substantially free of the material comprising a hydrogel.

In a third aspect, the present disclosure is directed to a method of manufacturing an article of footwear, apparel or sporting equipment, e.g. an article of the second aspect. The method comprises the steps of providing a component of an article of footwear, apparel or sporting equipment as disclosed herein, e.g. with respect to the first aspect of the disclosure, providing a second component, and securing the component and the second component to each other such that a material comprising a hydrogel defines at least a portion of a externally-facing surface of the article. The method can be a method comprising the steps of providing a component having a first, externally-facing surface of the component and a second surface opposing the first surface, wherein a material comprising a hydrogel defines at least a portion of the externally-facing first surface of the component; and securing the component and the second component to each other such that the material defines at least a portion of the externally-facing surface of the finished article. The method can further comprise the steps of securing the material to a first side of a backing substrate formed of a second material compositionally comprising a thermoplastic; thermoforming the material secured to the backing substrate formed of the second material to produce a component precursor, wherein the component precursor includes the material secured to the first side of the backing substrate; placing the component precursor in a mold; and injecting a third material compositionally comprising a thermopolymer onto a second side of the backing substrate of the component precursor while the component precursor is present in the mold to produce a finished component, wherein the finished component comprises a component substrate that includes the backing substrate and the third material; and the material secured to the component substrate.

In a fourth aspect, the present disclosure is directed to use of a material compositionally comprising a hydrogel to prevent or reduce soil accumulation on a component of an article of footwear, apparel or sporting equipment, or an article of footwear, apparel or sporting equipment. The use involves use of the material to prevent or reduce soil accumulation on a component or article on a first surface of the component, which first surface comprises the material, by providing the material on at least a portion of the first surface of the component, wherein the component or article retains at least 10% less soil by weight as compared to a second component or article which is identical except that the first surface of the second component or article is substantially free of the material comprising a hydrogel. The use can be a use of a material compositionally comprising a hydrogel to prevent or reduce soil accumulation on a first surface of a component or article, which first surface comprises the material, by providing the material on at least a portion of the first surface of the component or article, wherein the component or article retains at least 10% less soil by weight as compared to a second component or article which is identical except that the first surface of the second component or article is substantially free of the material comprising a hydrogel. The material can be a material as described above, e.g. with respect to the first aspect of the disclosure.

In a fifth aspect, the present disclosure is directed to a method of using an article of footwear, apparel or sporting equipment. The method comprises providing an article wherein a material comprising a hydrogel defines at least a portion of an externally-facing surface of the article; exposing the material to water to take up at least a portion of the water into the material, forming wet material; pressing the article with the wet material against a surface to at least partially compress the wet material; and releasing the article from contact with the surface to release the compression from the wet material. The material can be a material as described above, e.g. with respect to the first aspect of the disclosure. Additional aspects and description of the materials, components, articles, uses and methods of the present disclosure can be found below, with particular reference to the numbered Clauses provided below.

The present disclosure is directed to articles of footwear and footwear components; articles of apparel and apparel components; and articles of sports equipment and sporting equipment components. At least a portion of an externally-facing surface of the articles compositionally comprise a hydrogel material. The hydrogel material can be in the form of a film, fiber, yarn, and the like.

As used herein, the terms "article of footwear" and "footwear" are intended to be used interchangeably to refer to the same article. Similarly, "article of apparel" and "apparel" are intended to be used interchangeably. "Article of sporting equipment" and "sporting equipment" are intended to be used interchangeably. Examples of articles of footwear include shoes, sandals, boots, and the like. Examples of articles of apparel include garments such as shirts, pants, shorts, belts, hats, and the like. Examples of suitable articles of sporting equipment include golf clubs, golf club covers, golf club towels, golf club bags, bags used to carry equipment such as soccer balls, backpacks, camping gear such as tents, and the like. The term "article" is intended to be an article of footwear, an article of apparel, an article of sporting equipment, or any combination thereof. A "component" is intended to be a part which is used to form an article. Examples of footwear components include uppers, traction elements, midsoles, and the like. Examples of apparel components include sleeves, pant legs, hat brims, and the like. Examples of sporting equipment components include the bottoms of bags, handles, and the like.

As also used herein, the term "upper" is understood to refer to the portion of the footwear above the article and midsole when a midsole is present, e.g., the upper portion of an article of footwear. An upper has a first surface which is externally-facing when the upper is present in an article footwear, and an opposing second surface which defines the foot-receiving void of the article of footwear. The term "externally-facing" refers to the position the element is intended to be in when the element is present in an article of footwear, apparel or sporting equipment during normal use, i.e., the element is on or defines an external surface of the article during normal use. In other words, even though the element may not necessarily be externally-facing during various steps of manufacturing or shipping, if the element is intended to externally-facing during normal use, the element is understood to be externally-facing. As used herein, directional orientations for an article, such as "upward", "downward", "top", "bottom", "left", "right", and the like, are used for ease of discussion, and are not intended to limit the use of the article to any particular orientation.

As used herein, a filament is a fiber of indefinite length; a yarn is a continuous strand of fibers in a form suitable for knitting, braiding, weaving, etc., and includes monofilament yarns, spun yarns and twisted yarns; and a non-woven textile is a textile formed from one or more sheet or web structures formed by entangling fibers or filaments using mechanical, thermal, or chemical processes. As used herein, the term "film" includes one or more layers disposed on at least a portion of a surface, where the layer(s) can be provided as a single continuous segment on the surface or in multiple discontinuous segments on the surface, and is not intended to be limited by any application process (e.g., co-extrusion, injection molding, lamination, spray coating, etc.).

As discussed below, it has been found these articles can prevent or reduce the accumulation of soil on their surfaces during use or wear on unpaved surfaces. As used herein, the term "soil" can include any of a variety of materials commonly present on a ground or playing surface and which might otherwise adhere to an article or exposed midsole of a footwear article. Soil can include inorganic materials such as mud, sand, dirt, and gravel; organic matter such as grass, turf, leaves, other vegetation, and excrement; and combinations of inorganic and organic materials such as clay.

While not wishing to be bound by theory, it is believed that the materials of the present disclosure, as provided in any suitable form, such as films, yarns, filaments, fibers, and non-woven textiles, when sufficiently wet with water (including water containing dissolved, dispersed or otherwise suspended materials) can provide compressive compliance and/or expulsion of uptaken water. In particular, it is believed that the compressive compliance of the wet surface materials, the expulsion of liquid from the wet surface materials, or more preferably both in combination, can disrupt the adhesion of soil to the article and cohesion of the soil particles to each other.

This disruption in the adhesion and/or cohesion of soil is believed to be a responsible mechanism for preventing (or otherwise reducing) the soil from accumulating on the article (due to the presence of the wet material), or at least allows the soil to be removed with less effort (e.g., easier to wipe, brush, or otherwise physically remove). As can be appreciated, preventing soil from accumulating on articles of footwear, apparel, and sporting equipment can provide numerous benefits, such as preventing weight accumulation on the articles.

As used herein, the term "weight" refers to a mass value, such as having the units of grams, kilograms, and the like. Further, the recitations of numerical ranges by endpoints include the endpoints and all numbers within that numerical range. For example, a concentration ranging from 40% by weight to 60% by weight includes concentrations of 40% by weight, 60% by weight, and all water uptake capacities between 40% by weight and 60% by weight (e.g., 40.1%, 41%, 45%, 50%, 52.5%, 55%, 59%, etc. . . . ).

As used herein, the term "providing", such as for "providing an article", when recited in the claims, is not intended to require any particular delivery or receipt of the provided item. Rather, the term "providing" is merely used to recite items that will be referred to in subsequent elements of the claim(s), for purposes of clarity and ease of readability.

As used herein, the terms "preferred" and "preferably" refer to aspects of the invention that may afford certain benefits, under certain circumstances. However, other aspects may also be preferred, under the same or other circumstances. Furthermore, the recitation of one or more preferred aspects does not imply that other aspects are not useful, and is not intended to exclude other aspects from the scope of the present disclosure. As used herein, the terms "about" and "substantially" are used herein with respect to measurable values and ranges due to expected variations known to those skilled in the art (e.g., limitations and variability in measurements).

The article of footwear, apparel, and sporting equipment of the present disclosure may be designed for a variety of uses, such as sporting, athletic, military, work-related, recreational, or casual use.

For the article of footwear aspect, the article of footwear can be intended for outdoor use on unpaved surfaces (in part or in whole), such as on a ground surface including one or more of grass, turf, gravel, sand, dirt, clay, mud, and the like, whether as an athletic performance surface or as a general outdoor surface. However, the article of footwear may also be desirable for indoor applications, such as indoor sports including dirt playing surfaces for example (e.g., indoor baseball fields with dirt infields). As used herein, the terms "at least one" and "one or more of" an element are used interchangeably, and have the same meaning that includes a single element and a plurality of the elements, and may also be represented by the suffix "(s)" at the end of the element. For example, "at least one polyurethane", "one or more polyurethanes", and "polyurethane(s)" may be used interchangeably and have the same meaning.

In preferred aspects, the article of footwear is designed use in outdoor sporting activities, such as global football/soccer, golf, American football, rugby, baseball, running, track and field, cycling (e.g., road cycling and mountain biking), and the like. The article of footwear can optionally include traction elements (e.g., lugs, cleats, studs, and spikes) to provide traction on soft and slippery surfaces. Cleats, studs and spikes are commonly included in footwear designed for use in sports such as global football/soccer, golf, American football, rugby, baseball, and the like, which are frequently played on unpaved surfaces. Lugs and/or exaggerated tread patterns are commonly included in footwear including boots design for use under rugged outdoor conditions, such as trail running, hiking, and military use.

FIG. 1 illustrates an example article of footwear of the present disclosure, referred to as an article of footwear 100. As shown in FIG. 1, the footwear 100 includes an upper 110, a toe cap 111, an outsole 112, a back portion 113, and a as footwear components. Optionally, outsole 112 can include a plurality of traction elements (e.g., cleats, not shown). The material of the present disclosure can form or be present on any external or externally-facing side or surface of the article of footwear. For example, the material can form or be present on the upper 110, the toe cap 111, the outsole 112, the back portion 113, the, or any combination thereof.

The upper has a first side or surface which is externally-facing, and a second side or surface opposing the first side or surface. The second side or surface is configured to form a void to receive a user's foot. The upper 110 of the footwear 100 can be fabricated from materials known in the art for making articles of footwear. For example, the upper body 110 may be made from or include one or more components made from one or more of natural leather; a knit, braided, woven, or non-woven textile made in whole or in part of a natural fiber; a knit, braided, woven or non-woven textile made in whole or in part of a synthetic polymer, a film of a synthetic polymer, etc.; and combinations thereof.

The upper 110 and subcomponents of the upper 110 can be manufactured according to conventional techniques (e.g., molding, extrusion, thermoforming, stitching, knitting, etc.). While illustrated in FIG. 1 with a generic design, the upper 110 may alternatively have any desired aesthetic design, functional design, brand designators, and the like. In some aspects, one or more portions of the upper 110 (or the entirely of the upper 110) can be manufactured with one or more materials of the present disclosure, as discussed below.

The outsole 112 may be directly or otherwise operably secured to the upper 110 using any suitable mechanism or method. As used herein, the terms "operably secured to", such as for an outsole that is operably secured to an upper, refers collectively to direct connections, indirect connections, integral formations, and combinations thereof. For instance, for an outsole that is operably secured to an upper, the outsole can be directly connected to the upper (e.g., with an adhesive), the outsole can be indirectly connected to the upper (e.g., with an intermediate midsole), can be integrally formed with the upper (e.g., as a unitary component), and combinations thereof.

For example, the upper 110 may be stitched to the outsole 112, or the upper 110 may be glued to the outsole 112, such as at or near a. The footwear 100 can further include a midsole (not shown) secured between the upper 110 and the outsole 112, or can be enclosed by the outsole 112. When a midsole is present, the upper 110 may be stitched, glued, or otherwise attached to the midsole at any suitable location, such as at or below the.

As used herein, the term "polymer" refers to a molecule having polymerized units of one or more species of monomer. The term "polymer" is understood to include both homopolymers and copolymers. The term "copolymer" refers to a polymer having polymerized units of two or more species of monomers, and is understood to include terpolymers. As used herein, reference to "a" polymer or other chemical compound refers one or more molecules of the polymer or chemical compound, rather than being limited to a single molecule of the polymer or chemical compound. Furthermore, the one or more molecules may or may not be identical, so long as they fall under the category of the chemical compound. Thus, for example, "a" polylaurolactam is interpreted to include one or more polymer molecules of the polylaurolactam, where the polymer molecules may or may not be identical (e.g., different molecular weights and/or isomers).

The optional traction elements 114 can each include any suitable cleat, stud, spike, or similar element configured to enhance traction for a wearer during cutting, turning, stopping, accelerating, and backward movement. The traction elements 114 can be arranged in any suitable pattern along the bottom surface of the outsole 112. For instance, the traction elements can be distributed in groups or clusters along the outsole 112 (e.g., clusters of 2-8 traction elements). The traction elements can alternatively be arranged along the outsole 112 symmetrically or non-symmetrically between the medial side and the lateral side. Moreover, one or more of the traction elements can be arranged along a centerline of the outsole 112 between the medial side and the lateral side.

Furthermore, the traction elements can each independently have any suitable dimension (e.g., shape and size). For instance, in some designs, each traction element within a given cluster can have the same or substantially the same dimensions, and/or each traction element across the entirety of the outsole 112 may have the same or substantially the same dimensions. Alternatively, the traction elements within each cluster may have different dimensions, and/or each traction element across the entirety of the outsole 112 can have different dimensions.

Examples of suitable shapes for the traction elements include rectangular, hexagonal, cylindrical, conical, circular, square, triangular, trapezoidal, diamond, ovoid, as well as other regular or irregular shapes (e.g., curved lines, C-shapes, etc. . . . ). The traction elements can also have the same or different heights, widths, and/or thicknesses as each other, as further discussed below. The fraction elements can be incorporated into the outsole 112 by any suitable mechanism such that the traction elements preferably extend from the bottom surface of the outsole 112. For example, the traction elements can be integrally formed with the outsole 112 through a molding process. Alternatively, the outsole 112 can be configured to receive removable traction elements, such as screw-in or snap-in traction elements. In these aspects, the outsole 112 can include receiving holes (e.g., threaded or snap-fit holes), and the traction elements can be screwed or snapped into the receiving holes to secure the traction elements to the outsole 112.

The traction elements can be fabricated from any suitable material for use with the outsole 112. For example, the traction elements can include one or more of polymeric materials such as thermoplastic elastomers; thermoset polymers; elastomeric polymers; silicone polymers; natural and synthetic rubbers; composite materials including polymers reinforced with carbon fiber and/or glass; natural leather; metals such as aluminum, steel and the like; and combinations thereof. In aspects in which the traction elements are integrally formed with the outsole 112 (e.g., molded together), the traction elements can include the same materials as the outsole 112 (e.g., thermoplastic materials). Alternatively, in aspects in which the traction elements are separate and insertable into receiving holes of the outsole 112, the traction elements can include any suitable materials that can secured in the receiving holes of the outsole 112 (e.g., metals and thermoplastic materials).

Figure 2:
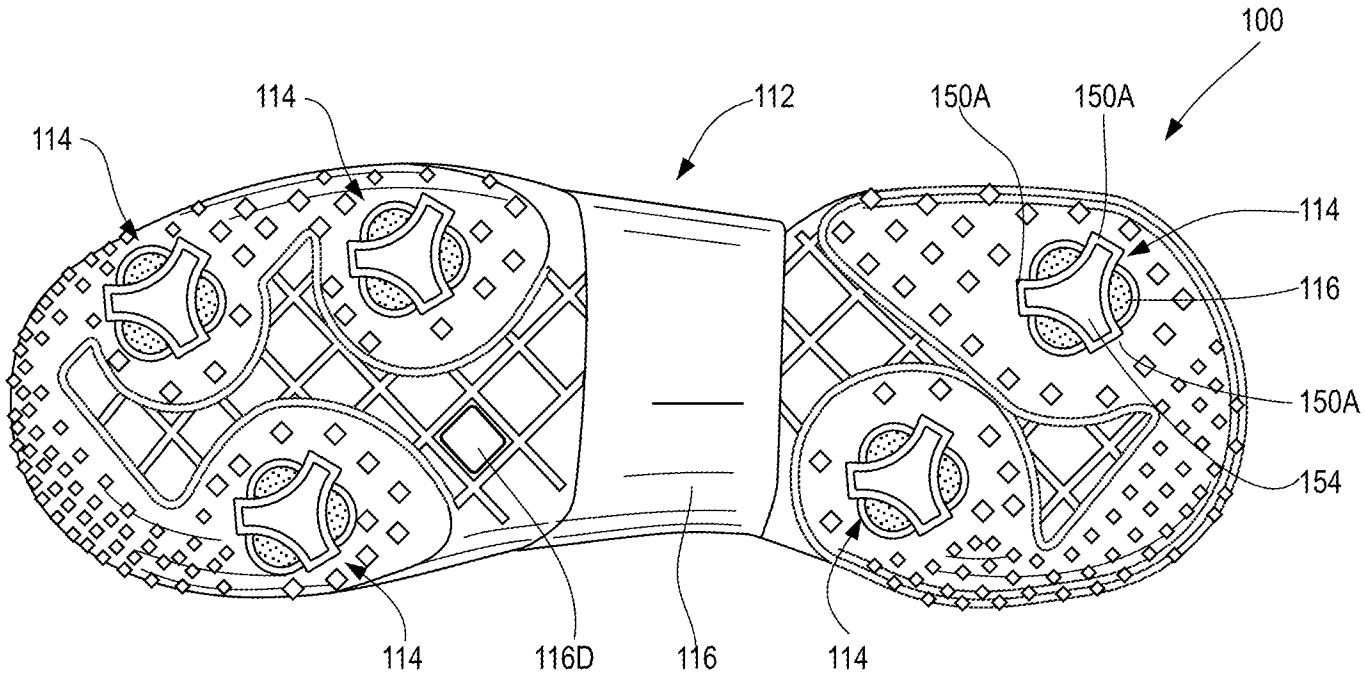
FIG. 2 is a bottom view of an article of footwear in another aspect of the present disclosure, which illustrates an example of a golf shoe including traction elements.

FIG. 2 illustrates an aspect in which the material is positioned on one or more portions of the outsole and/or traction elements in an article of golf footwear 100. In some cases, the material is present on one or more locations of the externally-facing surface of the outsole except the cleats 114 (e.g., a non-cleated surface). Alternatively or additionally, the material can be present as one or more segments 116D on one or more surfaces between tread patterns on an externally-facing surface of the outsole 112 of an article of footwear.

Alternatively or additionally, the material can be incorporated onto one or more surfaces of the traction elements 114. For example, the material can also be on a central region of traction element 114 between the shafts/spikes 150A, such as a surface opposing the area where the traction element 114 is mounted to the outsole 112. In many traction elements used for golf footwear, the traction element 114 has a generally flat central base region 154 and a plurality of shafts/spikes 150A arranged around the perimeter of the central region 154. In such traction elements, the material can be located on the generally flat central base region 154. Alternatively, the material can cover substantially all of the surface area of the traction element.

In such aspects, remaining regions of the outsole 112 can be free of the material. For example, the cleats 114 having material can be separate components that can be secured to the outsole 112 (e.g., screwed or snapped in), where the outsole 112 itself can be free of the material. In other words, the cleats 114 comprising the material can be provided as components for use with standard footwear not otherwise containing the material (e.g., golf shoes or otherwise).

Figure 3:
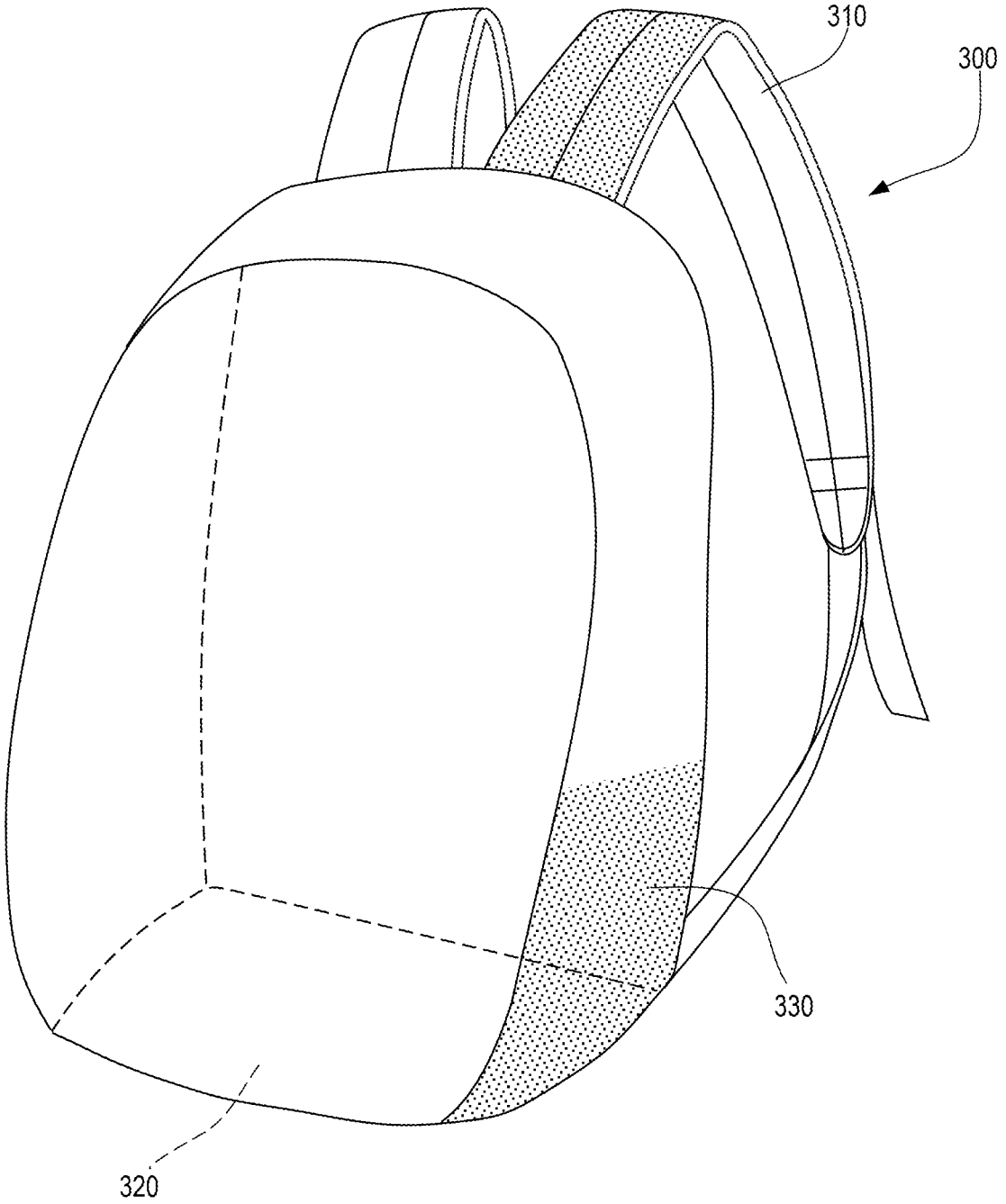
FIG. 3 is a perspective view of a backpack in accordance with the present disclosure.

FIG. 3 illustrates an aspect in which the material is incorporated into an article of sporting equipment, specifically a backpack 300. As shown in FIG. 3, an externally-facing surface of a shoulder strap 310 component of the backpack 300 includes the material. A portion of a side panel 330 of the backpack 300 also includes the material, as does the bottom 320 of the backpack 300.

Figure 4:
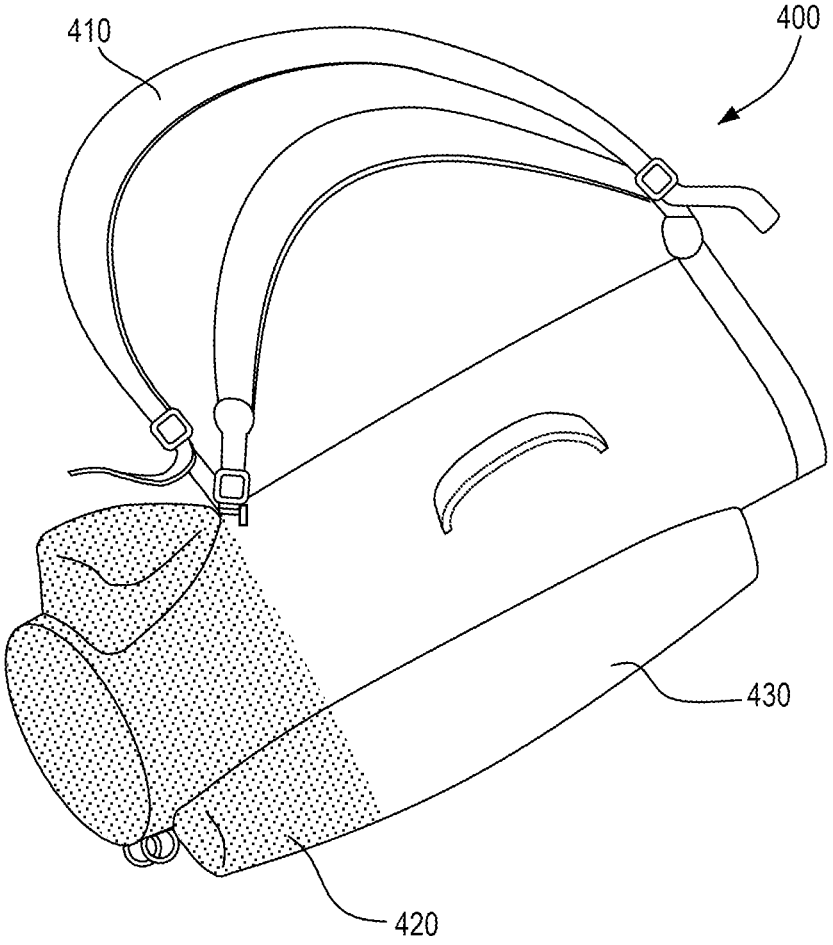
FIG. 4 is a perspective view of a golf bag in accordance with the present disclosure.

FIG. 4 illustrates another aspect in which the material is incorporated into an article of sporting equipment, specifically a golf bag 400. As shown in FIG. 4, the externally-facing surface of the bottom 420 of the golf bag includes the material. Other components of the article of sporting equipment can optionally comprise the material. For example, an externally-facing surface of a strap 410 component of the golf bag 400 can include the material (not shown), or at least a portion of a side panel 430 of the golf bag 400 can include the material (not shown), or both components can include the material.

Figure 5:
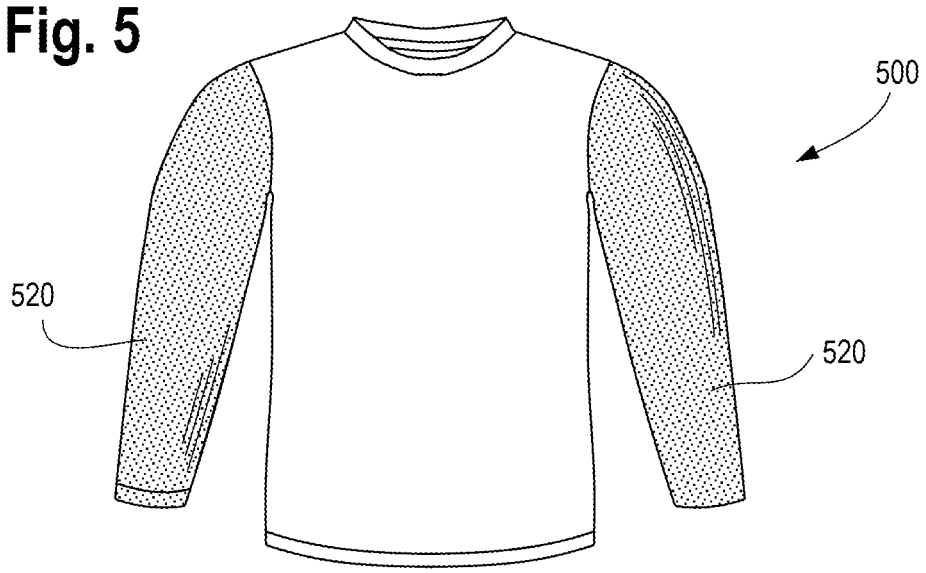
FIG. 5 is a perspective view of a shirt in accordance with the present disclosure.

FIG. 5 illustrates an aspect in which the material is incorporated into an article of apparel, specifically a t-shirt 500. As shown in FIG. 5, externally-facing surfaces of both sleeves 520 of the t-shirt 500 includes the material. Other components of the article of sporting equipment can optionally comprise the material.

Figure 6:
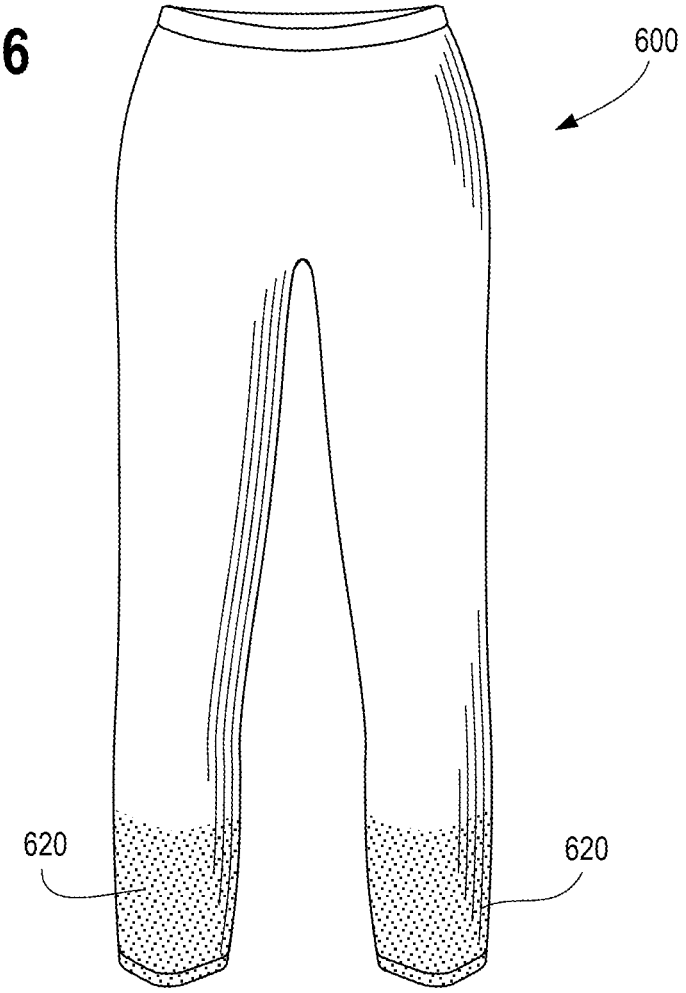
FIG. 6 is a perspective view of a pair of pants in accordance with the present disclosure.

FIG. 6 illustrates another aspect in which the material is incorporated into an article of apparel, specifically a pair of pants 600. As shown in FIG. 6, externally-facing surfaces of both pant legs 620 of the pair of pants 600 includes the material. Other components of the article of sporting equipment can optionally comprise the material.

The material can be in the form of a thin film. Examples of suitable average thicknesses for the material in a dry state (referred to as a dry-state film thickness) range from 0.025 millimeters to 5 millimeters, from 0.5 millimeters to 3 millimeters, from 0.25 millimeters to 1 millimeter, from 0.25 millimeters to 2 millimeters, from 0.25 millimeters to 5 millimeters, from 0.15 millimeters to 1 millimeter, from 0.15 millimeters to 1.5 millimeters, from 0.1 millimeters to 1.5 millimeters, from 0.1 millimeters to 2 millimeters, from 0.1 millimeters to 5 millimeters, from 0.1 millimeters to 1 millimeter, or from 0.1 millimeters to 0.5 millimeters. When present as a film on a backing material, the thickness of the material is measured between the interfacial bond between a backing material and an exterior surface of the material.

As briefly mentioned above, the material compositionally include a hydrogel. The presence of the hydrogel can allow the material to absorb or otherwise take up water. For example, the material can include a crosslinked polymeric network that can quickly take up water from an external environment (e.g., from mud, wet grass, presoaking, and the like).

Moreover, in aspects where the hydrogel is crosslinked, it is believed that this uptake of water by the material can cause the crosslinked polymer network of the material to swell and stretch under the pressure of the received water, while retaining its overall structural integrity through its crosslinking (physical or covalent crosslinking) This stretching and expansion of the polymer network can cause the material to swell and become more compliant (e.g., compressible, expandable, and stretchable). As used herein, the term "compliant" refers to the stiffness of an elastic material, and can be determined by the storage modulus of the material. The lower the degree of crosslinking in a material, or the greater the distance between crosslinks in a material, the more compliant the material.

The swelling of the material can be observed as an increase in film thickness from the dry-state thickness of the material, through a range of intermediate-state thicknesses as additional water is absorbed, and finally to a saturated-state thickness, which is an average thickness of the material when fully saturated with water. For example, the saturated-state thickness for the fully saturated material can be greater than 150%, greater than 200%, greater than 250%, greater than 300%, greater than 350%, greater than 400%, or greater than 500%, of the dry-state thickness 160 for the same material.

In some aspects, the saturated-state thickness for the fully saturated material range from 150% to 500%, from 150% to 400%, from 150% to 300%, or from 200% to 300% of the dry-state thickness for the same material. Examples of suitable average thicknesses for the material in a wet state (referred to as a saturated-state thickness) range from 0.2 millimeters to 10 millimeters, from 0.2 millimeters to 5 millimeters, from 0.2 millimeters to 2 millimeters, from 0.25 millimeters to 2 millimeters, or from 0.5 millimeters to 1 millimeter.

Preferably, the material can quickly take up water that is in contact with the material. For instance, the material can take up water from mud and wet grass, such as during a warmup period prior to a competitive match. Alternatively (or additionally), the material can be pre-conditioned with water so that the material is partially or fully saturated, such as by spraying or soaking the article with water prior to use.

The total amount of water that the material can take up depends on a variety of factors, such as its composition (e.g., its hydrophilicity), if crosslinked, its cross-linking density, its thickness, and its interfacial bond to a backing material (if present). For example, it is believed that a material having a higher hydrophilicity and a lower cross-linking density can increase the maximum water uptake for the material. On the other hand, the interfacial bond between the material and a backing material can potentially restrict the swelling of the material due to its relatively thin dimensions. Accordingly, as described below, the water uptake capacity and the swell capacity of the material can differ between the material in a neat state (isolated film by itself) and the material as present on a backing material.

The water uptake capacity and the water uptake rate of the material are dependent on the size and shape of its geometry, and are typically based on the same factors. However, it has been found that, to account for part dimensions when measuring water uptake capacity, it is possible to derive an intrinsic, steady-state material property. Therefore, conservation of mass can be used to define the ratio of water weight absorbed to the initial dry weight of the material at very long time scales (i.e. when the ratio is no longer changing at a measurable rate.)

Conversely, the water uptake rate is transient and is preferably defined kinetically. The three primary factors for water uptake rate for a given part geometry include time, thickness, and the exposed surface area available for water flux. Once again, the weight of water taken up can be used as a metric of water uptake rate, but the water uptake can also be accounted for by normalizing by the exposed surface area. For example, a thin rectangular film can be defined by $2 \times L \times W$, where L is the length of one side and W is the width. The value is doubled to account for the two major surfaces of the film, but the prefactor can be eliminated when the film has a non-absorbing, structural layer secured to one of the major surfaces (e.g., with an article backing plate).

Normalizing for thickness and time can require a more detailed analysis because they are coupled variables. Water penetrates deeper into the material as more time passes in the experiment, and therefore, there is more functional (e.g., absorbent) material available at longer time scales. One dimensional diffusion models can explain the relationship between time and thickness through material properties, such as diffusivity. In particular, the weight of water taken up per exposed surface area should yield a straight line when plotted against the square root of time.

However, several factors can occur where this model does not represent the data well. First, at long times absorbent materials become saturated and diffusion kinetics change due to the decrease in concentration gradient of the water. Second, as time progresses the material can be plasticized to increase the rate of diffusion, so once again the model do longer represents the physical process. Finally, competing processes can dominate the water uptake or weight change phenomenon, typically through surface phenomenon such as physisorption on a rough surface due to capillary forces. This is not a diffusion driven process, and the water is not actually be taken up into the material.

Even though the material can swell as it takes up water and transitions between the different material states with corresponding thicknesses, when present on a traction element, the saturated-state thickness of the material preferably remains less than the length of the traction element. This selection of the material and its corresponding dry and saturated thicknesses ensures that the traction elements can continue to provide ground-engaging traction during use of the footwear 100, even when the material is in a fully swollen state. For example, the average clearance difference between the lengths of the traction elements and the saturated-state thickness of the material is desirably at least 8 millimeters. For example, the average clearance distance can be at least 9 millimeters, 10 millimeters, or more.

As also mentioned above, in addition to swelling, the compliance of the material may also increase from being relatively stiff (dry state) to being increasingly stretchable, compressible, and malleable (in partially and fully saturated states). The increased compliance accordingly can allow the material to readily compress under an applied pressure (e.g., during a foot strike on the ground), which can quickly expel at least a portion of its retained water (depending on the extent of compression). While not wishing to be bound by theory, it is believed that this combination of compressive compliance and water expulsion can disrupt the adhesion and cohesion of soil, which prevents or otherwise reduces the accumulation of soil on article.

In addition to quickly expelling water, the compressed material may also be capable of quickly re-absorbing water when the compression is released (e.g., liftoff from a foot strike during normal use). As such, during use in a wet or damp environment (e.g., a muddy or wet ground), the material can dynamically expel and re-uptake water over successive foot strikes. As such, the material can continue to prevent soil accumulation over extended periods of time (e.g., during an entire competitive match), particularly when there is ground water available for re-uptake.

The incorporation of the material to the article is believed to disrupt the adhesion and cohesion of soil on the externally-facing surface of the article, thereby reducing the adhesive/cohesive activation energies otherwise required to induce the flow of the soil particles. The article can be provided in a pre-conditioned state where the material is partially or fully saturated with water. This can be accomplished in a variety of manners, such as spraying the article with water, soaking the article in water, or otherwise exposing the material to water in a sufficient amount for a sufficient duration. Alternatively (or additionally), when water or wet materials are present on the ground, the article can be used in a conventional manner until the material absorbs a sufficient amount of water from the ground or wet materials to reach its pre-conditioned state.

In some aspects, the material can swell during water re-uptake (and also during initial uptake) in a non-uniform manner. In such aspects, the uptaken water may tend to travel in a path perpendicular to the material's surface, and so may not migrate substantially in a transverse direction generally in the plane of the material once absorbed. This uneven, perpendicular water uptake and relative lack of transverse water intra-film transport can form an irregular or rough texture or small ridges on the surface of the material. The presence of these small ridges on the irregular surface from the non-uniform swelling are also believed to potentially further disrupt the adhesion of the soil to the material, and thus may loosen the soil and further promote soil shedding.

The increased compliance of the material, for example elongational compliance in the longitudinal direction, may allow the material to be more malleable and stretchable when swelled. The increased elongation or stretchiness of the material when partially or fully saturated with water can increase the extent that the material stretches during this flexing, which can induce additional shear on any soil adhered to the surface of the material. The foregoing properties of the material related to compression/expansion compliance and the elongation compliance are believed to be closely interrelated, and they can depend on the same material properties (e.g., a hydrophilic material able to able to rapidly take up and expel relatively large amounts of water compared to the material's size or thickness). A distinction is in their mechanisms for preventing soil accumulation, for example surface adhesion disruption versus shear inducement. The water re-uptake is believed to potentially act to quickly expand or swell the material after being compressed to expel water. Rapid water uptake can provide a mechanism for replenishing the material water content. Rapid replenishment of the material water content can restore the material to its compliant state, returning it to a state where stretching and shearing forces can contribute to soil shedding. In addition, replenishment of the material water content can permit subsequent water expulsion to provide an additional mechanism for preventing soil accumulation (e.g., application of water pressure and modification of soil rheology). As such, the water absorption/expulsion cycle can provide a unique combination for preventing soil accumulation on the article.

In addition to being effective at preventing soil accumulation, the material has also been found to be sufficiently durable for its intended use on the externally-facing side or surface of the article. Durability is based on the nature and strength of the interfacial bond of the material to a backing material (if present), as well as the physical properties of the material itself. For many examples, during the useful life of the material, the material may not delaminate from the backing material, and it can be substantially abrasion- and wear-resistant (e.g., maintaining its structural integrity without rupturing or tearing).

In various aspects, the useful life of the material (and the article containing it) is at least 10 hours, 20 hours, 50 hours, 100 hours, 120 hours, or 150 hours of wear. For example, in some applications, the useful life of the material ranges from 20 hours to 120 hours. In other applications, the useful life of the material ranges from 50 hours to 100 hours of use.

Interestingly, for many examples, the dry and wet states of the material can allow the material to dynamically adapt in durability to account for dry and wet surface play. For example, when used on a dry ground 166, the material can also be dry, which renders it stiffer and more wear resistant. Alternatively, when used on wet ground or when wet material is present on a dry ground, the material can quickly take up water to achieve a partially or fully saturated condition, which may be a swollen and/or compliant state. However, the wet ground imposes less wear on the swollen and compliant material compared to dry ground. As such, the material can be used in a variety of conditions, as desired. Nonetheless, the article are particularly beneficial for use in wet environments, such as with muddy surfaces, grass surfaces, and the like.

While in some aspect the material can extend across an entire externally-facing surface such as an entire bottom surface of an article, in alternative aspects, the material can alternatively be present as one or more segments that are present at separate, discrete locations on an externally-facing side or surface of an article or component of an article. For instance, as shown in FIG. 2, the material can alternatively be present as a first segment 116 or a second segment 116D secured to the bottom surface of an outsole 112 of an article of footwear 100. In these examples, the remaining regions of the surfaces, such as the remaining bottom surface of the outsole 112, can be free of the material.

As discussed above, the materials of the present disclosure, such as the material for use with the articles and components, can compositionally include a hydrogel that allows the material to take up water. As used herein, the terms "take up", "taking up", "uptake", "uptaking", and the like refer to the drawing of a liquid (e.g., water) from an external source into the film, such as by absorption, adsorption, or both. Furthermore, as briefly mentioned above, the term "water" refers to an aqueous liquid that can be pure water, or can be an aqueous carrier with lesser amounts of dissolved, dispersed or otherwise suspended materials (e.g., particulates, other liquids, and the like).

The ability of the material to take up water and to correspondingly swell and increase in compliance can reflect its ability to prevent soil accumulation during use with an article of footwear, apparel or sporting equipment. As discussed above, when the material takes up water (e.g., through absorption, adsorption, capillary action, etc. . . . ), the water taken up by the material transitions the material from a dry, relatively more rigid state to a partially or fully saturated state that is relatively more compliant. The presence of water at the surface of the material is believed to be one mechanism which reduces the adherence of soil to the material.

Additionally, when the material is then subjected to an application of pressure, either compressive or flexing, the material can reduce in volume, such as to expel at least a portion of its water. This expelled water is believed to reduce the adhesive/cohesive forces of soil particles at the article, which taken alone, or in combination with the material's compliance, can prevent or otherwise reduce soil accumulation at the article. Accordingly, the material can undergo dynamic transitions, and these dynamic transitions can result in forces which dislodge accumulated soil or otherwise reduce soil accumulation on the article as well.

Based on the multiple interacting mechanisms involved in reducing or preventing soil accumulation on the articles of the present disclosure, it has been found that different properties can be good at predicting soil-shedding performance. For instance, the articles of the present disclosure and the material can be characterized in terms of the material's water uptake capacity and rate, swell capacity, contact angle when wet, coefficient of friction when wet and dry, reduction in storage modulus from dry to wet, reduction in glass transition temperature from dry to wet, and the like.

The terms "Footwear Sampling Procedure", "Co-Extruded Film Sampling Procedure", "Neat Film Sampling Procedure", "Neat Material Sampling Procedure", "Water Uptake Capacity Test", "Water Uptake Rate Test", "Swelling Capacity Test", "Contact Angle Test", "Coefficient of Friction Test", "Storage Modulus Test", "Glass Transition Temperature Test", "Impact Energy Test", and "Soil Shedding Footwear Test" as used herein refer to the respective sampling procedures and test methodologies described in the Property Analysis And Characterization Procedure section below. These sampling procedures and test methodologies characterize the properties of the recited materials, films, articles, footwear, and the like, and are not required to be performed as active steps in the claims.

For example, in some aspects, the material as secured to an article has a water uptake capacity at 24 hours greater than 40% by weight, as characterized by the Water Uptake Capacity Test with the Footwear Sampling Procedure, the Apparel Sampling Procedure, or the Sporting Equipment Sampling Procedure, each as described below. It is believed that if a particular material is not capable of taking up greater than 40% by weight in water within a 24-hour period, either due to its water uptake rate being too slow, or its ability to take up water is too low (e.g., due to its thinness, not enough material may be present, or the overall capacity of the material to take up water is too low), then the material may not be effective in preventing or reducing soil accumulation.

In further aspects, the material as secured to, present in, or forming a portion of an article has a water uptake capacity at 24 hours of greater than 50% by weight, greater than 100% by weight, greater than 150% by weight, or greater than 200% by weight. In other aspects, the material as secured to a footwear article has a water uptake capacity at 24 hours less than 900% by weight, less than 750% by weight, less than 600% by weight, or less than 500% by weight.

In some aspects, the material has a water uptake capacity at 24 hours ranging from 40% by weight to 900% by weight. For example, the material can have a water uptake capacity ranging from 100% by weight to 900% by weight, from 100% by weight to 750% by weight, from 100% by weight to 700% by weight, from 150% by weight to 600% by weight, from 200% by weight to 500% by weight, or from 300% by weight to 500% by weight.

As discussed below, the water uptake capacity of the material can alternatively be measured in a simulated environment with the material co-extruded with a backing substrate. The backing substrate can be produced from any suitable material that is compatible with the material, such as a material used to form an article backing plate. As such, suitable water uptake capacities at 24 hours for the material as co-extruded with a backing substrate, as characterized by the Water Uptake Capacity Test with the Co-extruded Film Sampling Procedure, include those discussed above for the Water Uptake Capacity Test with the Footwear Sampling Procedure, the Apparel Sampling Procedure, or the Sporting Equipment Sampling Procedure.

Additionally, it has been found that when the material is secured to another surface, such as being thermally or adhesively bonded to an article substrate (e.g., an article backing plate), the interfacial bond formed between the material and the article substrate can restrict the extent that the material can take up water and/or swell. As such, it is believed that the material as bonded to an article substrate or co-extruded backing substrate can potentially have a lower water uptake capacity and/or a lower swell capacity compared to the same material in a neat film form or a neat material form.

As such, the water uptake capacity and the water uptake rate of the material can also be characterized based on the material in neat form (i.e., an isolated film that is not bonded to another material). The material in neat form can have a water uptake capacity at 24 hours greater than 40% by weight, greater than 100% by weight, greater than 300% by weight, or greater than 1000% by weight, as characterized by the Water Uptake Capacity Test with the Neat Film Sampling Procedure. The material in neat form can also have a water uptake capacity at 24 hours less than 900% by weight, less than 800% by weight, less than 700% by weight, less than 600% by weight, or less than 500% by weight.

In some particular aspects, the material in neat form has a water uptake capacity at 24 hours ranging from 40% by weight to 900% by weight, from 150% by weight to 700% by weight, from 200% by weight to 600% by weight, or from 300% by weight to 500% by weight.

The material as present on, secured to or forming at least a portion of an article (or component of an article) may also have a water uptake rate greater than 20 grams/(meter$^2$-minutes$^{1/2}$), as characterized by the Water Uptake Rate Test with the Footwear Sampling Procedure, the Apparel Sampling Procedure, or the Sporting Equipment Sampling Procedure.

As such, in further aspects, the material can have a water uptake rate greater than 20 grams/(meter$^2$-minutes$^{1/2}$), greater than 100 grams/(meter$^2$-minutes$^{1/2}$), greater than 200 grams/(meter$^2$-minutes$^{1/2}$), greater than 400 grams/(meter$^2$-minutes$^{1/2}$), or greater than 600 grams/(meter$^2$-minutes$^{1/2}$). In some aspects, the material has a water uptake rate ranging from 1 to 1,500 grams/(meter$^2$-minutes$^{1/2}$), 20 to 1,300 grams/(meter$^2$-minutes$^{1/2}$), from 30 to 1,200 grams/(meter$^2$-minutes$^{1/2}$), from 30 to 800 grams/(meter$^2$-minutes$^{1/2}$), from 100 to 800 grams/(meter$^2$-minutes$^{1/2}$), from 100 to 600 grams/(meter$^2$-minutes$^{1/2}$), from 150 to 450 grams/(meter$^2$-minutes$^{1/2}$), from 200 to 1,000 grams/(meter$^2$-minutes$^{1/2}$), from 400 to 1,000 grams/(meter$^2$-minutes$^{1/2}$), or from 600 to 900 grams/(meter$^2$-minutes$^{1/2}$).

Suitable water uptake rates for the material as secured to a co-extruded backing substrate, as characterized by the Water Uptake Rate Test with the Co-extruded Film Sampling Procedure, and as provided in neat form, as characterized by the Water Uptake Rate Test with the Neat Film Sampling Procedure, each include those discussed above for the Water Uptake Rate Test with the Footwear Sampling Procedure, the Apparel Sampling Procedure, or the Sporting Equipment Sampling Procedure.

In certain aspects, the material can also swell, increasing the material's thickness and/or volume, due to water uptake. This swelling of the material can be a convenient indicator showing that the material is taking up water, and can assist in rendering the material compliant. In some aspects, the material has an increase in thickness (or swell thickness increase) at 1 hour of greater than 20% or greater than 50%, for example ranging from 30% to 350%, from 50% to 400%, from 50% to 300%, from 100% to 300%, from 100% to 200%, or from 150% to 250%, as characterized by the Swelling Capacity Test with the Footwear Sampling Procedure, the Apparel Sampling Procedure, or the Sporting Equipment Sampling Procedure. In some further aspects, the material has an increase in thickness at 24 hours ranging from 45% to 400%, from 100% to 350%, or from 150% to 300%.

Additionally, the material can have an increase in volume (or volumetric swell increase) at 1 hour of greater than 50%, for example ranging from 10% to 130%, from 30% to 100%, or from 50% to 90%. Moreover, the material can have an increase in film volume at 24 hours ranging from 25% to 200%, from 50% to 150%, or from 75% to 100%.

For co-extruded film simulations, suitable increases in thickness and volume at 1 hour and 24 hours for the material as secured to a co-extruded backing substrate, as characterized by the Swelling Capacity Test with the Co-extruded Film Sampling Procedure, include those discussed above for the Swelling Capacity Test with the Footwear Sampling Procedure, the Apparel Sampling Procedure, or the Sporting Equipment Sampling Procedure.

The material in neat form can have an increase in thickness at 1 hour ranging from 35% to 400%, from 50% to 300%, or from 100% to 200%, as characterized by the Swelling Capacity Test with the Neat Film Sampling Procedure. In further aspects, the material in neat form can have an increase in thickness at 24 hours ranging 45% to 500%, from 100% to 400%, or from 150% to 300%. Correspondingly, the material in neat form can have an increase in volume at 1 hour ranging from 50% to 500%, from 75% to 400%, or from 100% to 300%.

As also discussed above, in some aspects, the surface of the material preferably exhibits hydrophilic properties. The hydrophilic properties of the material surface can be characterized by determining the static sessile drop contact angle of the film's surface. Accordingly, in some examples, the material in a dry state has a static sessile drop contact angle (or dry-state contact angle) of less than 105°, or less than 95°, less than 85°, as characterized by the Contact Angle Test (independent of film sampling process). In some further examples, the material in a dry state has a static sessile drop contact angle ranging from 60° to 100°, from 70° to 100°, or from 65° to 95°.

In other examples, the material in a saturated state has a static sessile drop contact angle (or wet-state contact angle) of less than 90°, less than 80°, less than 70°, or less than 60°. In some further examples, the material in a saturated state has a static sessile drop contact angle ranging from 45° to 75°. In some cases, the dry-state static sessile drop contact angle of the material surface is greater than the wet-state static sessile drop contact angle of the material surface by at least 10°, at least 15°, or at least 20°, for example from 10° to 40°, from 10° to 30°, or from 10° to 20°.

The surface of the material (and of the article in general) can also exhibit a low coefficient of friction when the material is partially or fully saturated. Examples of suitable coefficients of friction for the material in a dry state (or dry-state coefficient of friction) are less than 1.5, for instance ranging from 0.3 to 1.3, or from 0.3 to 0.7, as characterized by the Coefficient of Friction Test with the Footwear Sampling Procedure, the Apparel Sampling Procedure, the Sporting Equipment Sampling Procedure, the Co-extruded Film Sampling Procedure, or the Neat Film Sampling Procedure. Examples of suitable coefficients of friction for the wet material (or wet-state coefficient of friction) are less than 0.8 or less than 0.6, for instance ranging from 0.05 to 0.6, from 0.1 to 0.6, or from 0.3 to 0.5. Furthermore, the material can exhibit a reduction in its coefficient of friction from its dry state to its wet state, such as a reduction ranging from 15% to 90%, or from 50% to 80%. In some cases, the dry-state coefficient of friction is greater than the wet-state coefficient of friction for the material, for example being higher by a value of at least 0.3 or 0.5, such as 0.3 to 1.2 or 0.5 to 1.

Furthermore, the compliance of the material can be characterized by its storage modulus in the dry state (when equilibrated at 0% relative humidity (RH)), and in a wet state (e.g., when equilibrated at 50% RH or 90% RH), and by reductions in its storage modulus between the dry and wet states. In particular, the material can have a reduction in storage modulus (ΔE') from the dry state relative to the wet state. A reduction in storage modulus as the water concentration in the material increases corresponds to an increase in compliance, because less stress is required for a given strain/deformation.

In some aspects, the material exhibits a reduction in the storage modulus from its dry state to its wet state of more than 20%, more than 40%, more than 60%, more than 75%, more than 90%, or more than 99%, relative to the storage modulus in the dry state, and as characterized by the Storage Modulus Test with the Neat Film Sampling Process or the Neat Material Sampling Process.

In some further aspects, the dry-state storage modulus of the material is greater than its wet-state (or saturated-state) storage modulus by more than 25 megaPascals (MPa), by more than 50 MPa, by more than 100 MPa, by more than 300 MPa, or by more than 500 MPa, for example ranging from 25 MPa to 800 MPa, from 50 MPa to 800 MPa, from 100 MPa to 800 MPa, from 200 MPa to 800 MPa, from 400 MPa to 800 MPa, from 25 MPa to 200 MPa, from 25 MPa to 100 MPa, or from 50 MPa to 200 MPa. Additionally, the dry-state storage modulus can range from 40 MPa to 800 MPa, from 100 MPa to 600 MPa, or from 200 MPa to 400 MPa, as characterized by the Storage Modulus Test. Additionally, the wet-state storage modulus can range from 0.003 MPa to 100 MPa, from 1 MPa to 60 MPa, or from 20 MPa to 40 MPa.

In addition to a reduction in storage modulus, the material can also exhibit a reduction in its glass transition temperature from the dry state (when equilibrated at 0% relative humidity (RH) to the wet state (when equilibrated at 90% RH). While not wishing to be bound by theory, it is believed that the water taken up by the material plasticizes the material, which reduces its storage modulus and its glass transition temperature, rendering the material more compliant (e.g., compressible, expandable, and stretchable).

In some aspects, the material can exhibit a reduction in glass transition temperature ($\Delta T_g$) from its dry-state glass transition temperature to its wet-state glass transition temperature of more than a 5° C. difference, more than a 6° C. difference, more than a 10° C. difference, or more than a 15° C. difference, as characterized by the Glass Transition Temperature Test with the Neat Film Sampling Process or the Neat Material Sampling Process. For instance, the reduction in glass transition temperature ($\Delta T_g$) can range from more than a 5° C. difference to a 40° C. difference, from more than a 6° C. difference to a 50° C. difference, form more than a 10° C. difference to a 30° C. difference, from more than a 30° C. difference to a 45° C. difference, or from a 15° C. difference to a 20° C. difference. The material can also exhibit a dry glass transition temperature ranging from −40° C. to −80° C., or from −40° C. to −60° C.

Alternatively (or additionally), the reduction in glass transition temperature ($\Delta T_g$) can range from a 5° C. difference to a 40° C. difference, form a 10° C. difference to a 30° C. difference, or from a 15° C. difference to a 20° C.

difference. The material can also exhibit a dry glass transition temperature ranging from −40° C. to −80° C., or from −40° C. to −60° C.

In some further aspects, the material can exhibit a soil shedding ability with a relative impact energy ranging from 0 to 0.9, from 0.2 to 0.7, or from 0.4 to 0.5, as characterized by the Impact Energy Test with the Footwear Sampling Procedure, the Apparel Sampling Procedure, the Sporting Equipment Sampling Procedure, the Co-extruded Film Sampling Procedure, or the Neat Film Sampling Procedure. Moreover, the material can be durable enough for use over extended durations. For instance, it has been found that the material of the present disclosure can, in some aspects, continue to perform without significant visual abrasion or delamination for more than 80 or 100 hours of use, as discussed above.

As discussed above, in some aspects, one or more portions of the upper 110 (or the entirely of the upper 110) can be manufactured with one or more materials capable of taking up water (e.g., the material can include one or more hydrogels). As such, the above-discussed properties for the material and the below-discussed compositions for the material can also apply to the exterior-facing surfaces of articles of footwear and components of articles of footwear (e.g., upper and fraction elements), to articles of apparel (e.g., shirts, tops, pants, shorts, socks, hats, external pads worn during sports, and the like) and components of articles of apparel (e.g., sleeves, pant legs, back panels, etc.), and to articles of sporting equipment (e.g., golf clubs, golf club covers, golf club towels, golf club bags, bags used to carry equipment such as soccer balls, backpacks, camping gear such as tents, and the like), and the components of articles of sporting equipment (e.g., the bottom portions of bags and back packs, the side panels of bags, the handles of bags, etc.).

In particular aspects, the material (and the surface of the upper, article of apparel, and article of sporting equipment) compositionally includes a hydrogel and, optionally, one or more additives. As used herein, the term "hydrogel" refers to a polymeric material that is capable of taking up at least 10% by weight in water, based on a dry weight of the polymeric material. The hydrogel can include a crosslinked or crosslinkable polymeric network, where crosslinks interconnect multiple polymer chains to form the polymeric network, and where the crosslinks can be physical crosslinks, covalent crosslinks, or can include both physical and covalent crosslinks (within the same polymeric network). The hydrogel can constitute more than 50% by weight of the entire material, or more than 75% by weight, or more 85% by weight, or more than 95% by weight. In some aspects, the material consists essentially of the hydrogel.

For a physical crosslink, a copolymer chain can form entangled regions and/or crystalline regions through non-covalent (non-bonding) interactions, such as, for example, an ionic bond, a polar bond, and/or a hydrogen bond. In particular, the crystalline regions create the physical crosslink between the copolymer chains whereas the non-bonding interactions form the crystalline domains (which include hard segments, as described below). These hydrogels can exhibit sol-gel reversibility, allowing them to function as thermoplastic polymers, which can be advantageous for manufacturing and recyclability. As such, in some aspects, the hydrogel of the film material includes a physically crosslinked polymeric network to function as a thermoplastic hydrogel.

The physically crosslinked hydrogels can be characterized by hard segments and soft segments, which can exist as phase separated regions within the polymeric network while the film material is in a solid (non-molten) state. The hard segments can form portions of the polymer chain backbones, and can exhibit high polarities, allowing the hard segments of multiple polymer chains to aggregate together, or interact with each other, to form semi-crystalline regions of the polymeric network.

A "semi-crystalline" or "crystalline" region has an ordered molecular structure with sharp melt points, which remains solid until a given quantity of heat is absorbed and then rapidly changes into a low viscosity liquid. A "pseudo-crystalline" region has properties of a crystal, but does not exhibit a true crystalline diffraction pattern. For ease of reference, the term "crystalline region" will be used herein to collectively refer to a crystalline region, a semi-crystalline region, and a pseudo-crystalline region of a polymeric network.

In comparison, the soft segments can be longer, more flexible, hydrophilic regions of the polymeric network that allow the polymer network to expand and swell under the pressure of taken up water. The soft segments can constitute amorphous hydrophilic regions of the hydrogel or crosslinked polymeric network. The soft segments, or amorphous regions, can also form portions of the backbones of the polymer chains along with the hard segments. Additionally, one or more portions of the soft segments, or amorphous regions, can be grafted or otherwise extend as pendant chains that extend from the backbones at the soft segments. The soft segments, or amorphous regions, can be covalently bonded to the hard segments, or crystalline regions (e.g., through carbamate linkages). For example, a plurality of amorphous hydrophilic regions can be covalently bonded to the crystalline regions of the hard segments.

Thus, in various aspects, the hydrogel or crosslinked polymeric network includes a plurality of copolymer chains wherein at least a portion of the copolymer chains each comprise a hard segment physically crosslinked to other hard segments of the copolymer chains and a soft segment covalently bonded to the hard segment, such as through a carbamate group or an ester group. In some cases, the hydrogel, or crosslinked polymeric network, includes a plurality of copolymer chains wherein at least a portion of the copolymer chains each comprise a first chain segment physically crosslinked to at least one other copolymer chain of the plurality of copolymer chains and a hydrophilic segment (e.g., a polyether chain segment) covalently bonded to the first chain segment, such as through a carbamate group or an ester group.

In various aspects, the hydrogel or crosslinked polymeric network includes a plurality of copolymer chains, wherein at least a portion of the copolymer chains each include a first segment forming at least a crystalline region with other hard segments of the copolymer chains; and a second segment, such as a soft segment (e.g., a segment having polyether chains or one or more ether groups) covalently bonded to the first segment, where the soft segment forms amorphous regions of the hydrogel or crosslinked polymeric network. In some cases, the hydrogel or crosslinked polymeric network includes a plurality of copolymer chains, where at least a portion of the copolymer chains have hydrophilic segments.

The soft segments, or amorphous regions, of the copolymer chains can constitute a substantial portion of the polymeric network, allowing their hydrophilic segments or groups to attract water molecules. In some aspects, the soft segments, or amorphous regions, are present in the copolymer chains in a ratio (relative to the hard segments, or crystalline regions) that is at least or greater than 20:1 by weight, that ranges from 20:1 to 110:1 by weight, or from 40:1 to 110:1 by weight, or from 40:1 to 80:1 by weight, or from 60:1 to 80:1.

For a covalent crosslink, one polymer chain is linked to one or more additional polymer chains with one or more covalent bonds, typically with a linking segment or chain. Covalently crosslinked hydrogels (e.g., thermoset and photocured hydrogels) can be prepared by covalently linking the polymer chains together using one or more multi-functional compounds, such as, for example, a molecule having at least two ethylenically-unsaturated groups, at least two oxirane groups (e.g., diepoxides), or combinations thereof (e.g., glycidyl methacrylate); and can also include any suitable intermediate chain segment, such as $C_{1-30}$, $C_{2-20}$, or $C_{2-10}$ hydrocarbon, polyether, or polyester chain segments.

The multi-functional compounds can include at least three functional groups selected from the group consisting of isocyanidyl, hydroxyl, amino, sulfhydryl, carboxyl or derivatives thereof, and combinations thereof. In some aspects, such as when the polymer network includes polyurethane, the multi-functional compound can be a polyol having three or more hydroxyl groups (e.g., glycerol, trimethylolpropane, 1,2,6-hexanetriol, 1,2,4-butanetriol, trimethylolethane) or a polyisocyanate having three or more isocyanate groups. In some cases, such as when the polymer network includes polyamide, the multi-functional compound can include, for example, carboxylic acids or activated forms thereof having three or more carboxyl groups (or activated forms thereof, polyamines having three or more amino groups, and polyols having three or more hydroxyl groups (e.g., glycerol, trimethylolpropane, 1,2,6-hexanetriol, 1,2,4-butanetriol, and trimethylolethane). In various cases, such as when the polymer network includes polyolefin, the multi-functional compound can be a compound having two ethylenically-unsaturated groups.

It has been found that the crosslinking density of the crosslinked hydrogel can impact the structural integrity and water uptake capacities of the material. If the crosslinking density is too high, the resulting material can be stiff and less compliant, which can reduce its water uptake and swelling capacity. On the other hand, if the crosslinking density is too low, then the resulting material can lose its structural integrity when saturated. As such, the hydrogel(s) of the material can have a balanced crosslinking density such that the material retains its structural integrity, yet is also sufficiently compliant when partially or fully saturated with water.

The crosslinked polymer network of the hydrogel for the material (e.g., the material) can include any suitable polymer chains that provide the desired functional properties (e.g., water uptake, swelling, and more generally, preventing soil accumulation), and also desirably provide good durability for the article. For example, the hydrogel can be based on one or more polyurethanes, one or more polyamides, one or more polyolefins, and combinations thereof (e.g., a hydrogel based on polyurethane(s) and polyamide(s)). In these aspects, the hydrogel or crosslinked polymeric network can include a plurality of copolymer chains wherein at least a portion of the copolymer chains each include a polyurethane segment, a polyamide segment, or a combination thereof. In some aspects, the one or more polyurethanes, one or more polyamides, one or more polyolefins, and combinations thereof include polysiloxane segments and/or ionomer segments.

In some aspects, the hydrogel includes a crosslinked polymeric network with one or more polyurethane copolymer chains (i.e., a plurality of polyurethane chains) that are physically and/or covalently crosslinked (referred to as a "polyurethane hydrogel"). The polyurethane hydrogel can be produced by polymerizing one or more isocyanates with one or more polyols to produce copolymer chains having carbamate linkages (—N(CO)O—) as illustrated below in Formula 1, where the isocyanate(s) each preferably include two or more isocyanate (—NCO) groups per molecule, such as 2, 3, or 4 isocyanate groups per molecule (although, single-functional isocyanates can also be optionally included, e.g., as chain terminating units).

(Formula 1)

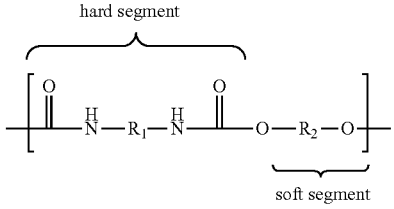

In these aspects, each $R_1$ independently is an aliphatic or aromatic segment, and each $R_2$ is a hydrophilic segment.

Unless otherwise indicated, any of the functional groups or chemical compounds described herein can be substituted or unsubstituted. A "substituted" group or chemical compound, such as an alkyl, alkenyl, alkynyl, cycloalkyl, cycloalkenyl, aryl, heteroaryl, alkoxyl, ester, ether, or carboxylic ester refers to an alkyl, alkenyl, alkynyl, cycloalkyl, cycloalkenyl, aryl, heteroaryl, alkoxyl, ester, ether, or carboxylic ester group, has at least one hydrogen radical that is substituted with a non-hydrogen radical (i.e., a substitutent). Examples of non-hydrogen radicals (or substituents) include, but are not limited to, alkyl, cycloalkyl, alkenyl, cycloalkenyl, alkynyl, ether, aryl, heteroaryl, heterocycloalkyl, hydroxyl, oxy (or oxo), alkoxyl, ester, thioester, acyl, carboxyl, cyano, nitro, amino, amido, sulfur, and halo. When a substituted alkyl group includes more than one non-hydrogen radical, the substituents can be bound to the same carbon or two or more different carbon atoms.

Additionally, the isocyanates can also be chain extended with one or more chain extenders to bridge two or more isocyanates. This can produce polyurethane copolymer chains as illustrated below in Formula 2, wherein $R_3$ includes the chain extender.

(Formula 2)

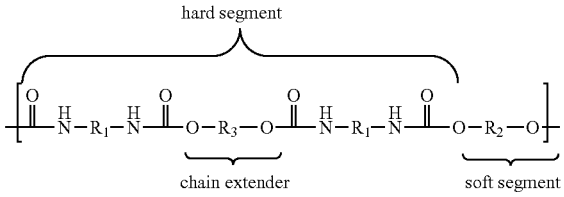

Each segment $R_1$, or the first segment, in Formulas 1 and 2 can independently include a linear or branched $C_{3-30}$ segment, based on the particular isocyanate(s) used, and can be aliphatic, aromatic, or include a combination of aliphatic portions(s) and aromatic portion(s). The term "aliphatic" refers to a saturated or unsaturated organic molecule that does not include a cyclically conjugated ring system having delocalized pi electrons. In comparison, the term "aromatic" refers to a cyclically conjugated ring system having delocalized pi electrons, which exhibits greater stability than a hypothetical ring system having localized pi electrons.

In aliphatic aspects (from aliphatic isocyanate(s)), each segment $R_1$ can include a linear aliphatic group, a branched aliphatic group, a cycloaliphatic group, or combinations thereof. For instance, each segment $R_1$ can include a linear or branched $C_{3-20}$ alkylene segment (e.g., $C_{4-15}$ alkylene or $C_{6-10}$ alkylene), one or more $C_{3-8}$ cycloalkylene segments (e.g., cyclopropyl, cyclobutyl, cyclopentyl, cyclohexyl, cycloheptyl, or cyclooctyl), and combinations thereof.

Examples of suitable aliphatic diisocyanates for producing the polyurethane copolymer chains include hexamethylene diisocyanate (HDI), isophorone diisocyanate (IPDI), butylene diisocyanate (BDI), bisisocyanatocyclohexylmethane (HMDI), 2,2,4-trimethylhexamethylene diisocyanate (TMDI), bisisocyanatomethylcyclohexane, bisisocyanatomethyltricyclodecane, norbornane diisocyanate (NDI), cyclohexane diisocyanate (CHDI), 4,4'-dicyclohexylmethane diisocyanate (H12MDI), diisocyanatododecane, lysine diisocyanate, and combinations thereof.

In aromatic aspects (from aromatic isocyanate(s)), each segment $R_1$ can include one or more aromatic groups, such as phenyl, naphthyl, tetrahydronaphthyl, phenanthrenyl, biphenylenyl, indanyl, indenyl, anthracenyl, and fluorenyl. Unless otherwise indicated, an aromatic group can be an unsubstituted aromatic group or a substituted aromatic group, and can also include heteroaromatic groups. "Heteroaromatic" refers to monocyclic or polycyclic (e.g., fused bicyclic and fused tricyclic) aromatic ring systems, where one to four ring atoms are selected from oxygen, nitrogen, or sulfur, and the remaining ring atoms are carbon, and where the ring system is joined to the remainder of the molecule by any of the ring atoms. Examples of suitable heteroaryl groups include pyridyl, pyrazinyl, pyrimidinyl, pyrrolyl, pyrazolyl, imidazolyl, thiazolyl, tetrazolyl, oxazolyl, isooxazolyl, thiadiazolyl, oxadiazolyl, furanyl, quinolinyl, isoquinolinyl, benzoxazolyl, benzimidazolyl, and benzothiazolyl.

Examples of suitable aromatic diisocyanates for producing the polyurethane copolymer chains include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some aspects, the copolymer chains are substantially free of aromatic groups.

In some preferred aspects, the polyurethane copolymer chains are produced from diisocynates including HMDI, TDI, MDI, $H_{12}$ aliphatics, and combinations thereof.

Examples of suitable triisocyanates for producing the polyurethane copolymer chains include TDI, HDI, and IPDI adducts with trimethyloylpropane (TMP), uretdiones (i.e., dimerized isocyanates), polymeric MDI, and combinations thereof.

Segment $R_3$ in Formula 2 can include a linear or branched $C_2$-$C_{10}$ segment, based on the particular chain extender polyol used, and can be, for example, aliphatic, aromatic, or polyether. Examples of suitable chain extender polyols for producing the polyurethane copolymer chains include ethylene glycol, lower oligomers of ethylene glycol (e.g., diethylene glycol, triethylene glycol, and tetraethylene glycol), 1,2-propylene glycol, 1,3-propylene glycol, lower oligomers of propylene glycol (e.g., dipropylene glycol, tripropylene glycol, and tetrapropylene glycol), 1,4-butylene glycol, 2,3-butylene glycol, 1,6-hexanediol, 1,8-octanediol, neopentyl glycol, 1,4-cyclohexanedimethanol, 2-ethyl-1,6-hexanediol, 1-methyl-1,3-propanediol, 2-methyl-1,3-propanediol, dihydroxyalkylated aromatic compounds (e.g., bis (2-hydroxyethyl) ethers of hydroquinone and resorcinol, xylene-α,α-diols, bis(2-hydroxyethyl) ethers of xylene-α,α-diols, and combinations thereof.

Segment $R_2$ in Formula 1 and 2 can include polyether, polyester, polycarbonate, an aliphatic group, or an aromatic group, wherein the aliphatic group or aromatic group is substituted with one or more pendant hydrophilic groups selected from the group consisting of hydroxyl, polyether, polyester, polylactone (e.g., polyvinylpyrrolidone (PVP)), amino, carboxylate, sulfonate, phosphate, ammonium (e.g., tertiary and quaternary ammonium), zwitterion (e.g., a betaine, such as poly(carboxybetaine (pCB) and ammonium phosphonates such as phosphatidylcholine), and combinations thereof. Therefore, the hydrophilic segment of $R_2$ can form portions of the hydrogel backbone, or be grafted to the hydrogel backbone as a pendant group. In some aspects, the pendant hydrophilic group or segment is bonded to the aliphatic group or aromatic group through a linker. Each segment $R_2$ can be present in an amount of 5% to 85% by weight, from 5% to 70% by weight, or from 10% to 50% by weight, based on the total weight of the reactant monomers.

In some aspects, at least one $R_2$ segment includes a polyether segment (i.e., a segment having one or more ether groups). Suitable polyethers include, but are not limited to polyethylene oxide (PEO), polypropylene oxide (PPO), polytetrahydrofuran (PTHF), polytetramethylene oxide (PTMO), and combinations thereof. The term "alkyl" as used herein refers to straight chained and branched saturated hydrocarbon groups containing one to thirty carbon atoms, for example, one to twenty carbon atoms, or one to ten carbon atoms. The term $C_n$ means the alkyl group has "n" carbon atoms. For example, $C_4$ alkyl refers to an alkyl group that has 4 carbon atoms. $C_{1-7}$ alkyl refers to an alkyl group having a number of carbon atoms encompassing the entire range (i.e., 1 to 7 carbon atoms), as well as all subgroups (e.g., 1-6, 2-7, 1-5, 3-6, 1, 2, 3, 4, 5, 6, and 7 carbon atoms). Nonlimiting examples of alkyl groups include, methyl, ethyl, n-propyl, isopropyl, n-butyl, sec-butyl (2-methylpropyl), t-butyl (1,1-dimethylethyl), 3,3-dimethylpentyl, and 2-ethylhexyl. Unless otherwise indicated, an alkyl group can be an unsubstituted alkyl group or a substituted alkyl group.

In some cases, at least one $R_2$ segment includes a polyester segment. The polyester can be derived from the polyesterification of one or more dihydric alcohols (e.g., ethylene glycol, 1,3-propylene glycol, 1,2-propylene glycol, 1,4-butanediol, 1,3-butanediol, 2-methylpentanediol-1,5, diethylene glycol, 1,5-pentanediol, 1,5-hexanediol, 1,2-dodecanediol, cyclohexanedimethanol, and combinations thereof) with one or more dicarboxylic acids (e.g., adipic acid, succinic acid, sebacic acid, suberic acid, methyladipic acid, glutaric acid, pimelic acid, azelaic acid, thiodipropionic acid and citraconic acid and combinations thereof). The polyester also can be derived from polycarbonate prepolymers, such as poly(hexamethylene carbonate) glycol, poly (propylene carbonate) glycol, poly(tetramethylene carbonate)glycol, and poly(nonanemethylene carbonate) glycol. Suitable polyesters can include, for example, polyethylene adipate (PEA), poly(1,4-butylene adipate), poly(tetramethylene adipate), poly(hexamethylene adipate), polycaprolactone, polyhexamethylene carbonate, poly(propylene carbonate), poly(tetramethylene carbonate), poly (nonanemethylene carbonate), and combinations thereof.

In various cases, at least one $R_2$ segment includes a polycarbonate segment. The polycarbonate can be derived from the reaction of one or more dihydric alcohols (e.g., ethylene glycol, 1,3-propylene glycol, 1,2-propylene glycol, 1,4-butanediol, 1,3-butanediol, 2-methylpentanediol-1,5, diethylene glycol, 1,5-pentanediol, 1,5-hexanediol, 1,2-dodecanediol, cyclohexanedimethanol, and combinations thereof) with ethylene carbonate.

In various aspects, at least one $R_2$ segment includes an aliphatic group substituted with one or more hydrophilic groups selected from the group consisting of hydroxyl, polyether, polyester, polylactone (e.g., polyvinylpyrrolidone), amino, carboxylate, sulfonate, phosphate, ammonium (e.g., tertiary and quaternary ammonium), zwitterion (e.g., a betaine, such as poly(carboxybetaine (pCB) and ammonium phosphonates such as phosphatidylcholine), and combinations thereof. In some aspects, the aliphatic group is linear and can include, for example, a $C_{1-20}$ alkylene chain or a $C_{1-20}$ alkenylene chain (e.g., methylene, ethylene, propylene, butylene, pentylene, hexylene, heptylene, octylene, nonylene, decylene, undecylene, dodecylene, tridecylene, ethenylene, propenylene, butenylene, pentenylene, hexenylene, heptenylene, octenylene, nonenylene, decenylene, undecenylene, dodecenylene, tridecenylene). The term "alkylene" refers to a bivalent hydrocarbon. The term $C_n$ means the alkylene group has "n" carbon atoms. For example, $C_{1-6}$alkylene refers to an alkylene group having, e.g., 1, 2, 3, 4, 5, or 6 carbon atoms. The term "alkenylene" refers to a bivalent hydrocarbon having at least one double bond.

In some cases, at least one $R_2$ segment includes an aromatic group substituted with one or more hydrophilic groups selected from the group consisting of hydroxyl, polyether, polyester, polylactone (e.g., polyvinylpyrrolidone), amino, carboxylate, sulfonate, phosphate, ammonium (e.g., tertiary and quaternary ammonium), zwitterion (e.g., a betaine, such as poly(carboxybetaine (pCB) and ammonium phosphonates such as phosphatidylcholine), and combinations thereof. Suitable aromatic groups include, but are not limited to, phenyl, naphthyl, tetrahydronaphthyl, phenanthrenyl, biphenylenyl, indanyl, indenyl, anthracenyl, fluorenylpyridyl, pyrazinyl, pyrimidinyl, pyrrolyl, pyrazolyl, imidazolyl, thiazolyl, tetrazolyl, oxazolyl, isooxazolyl, thiadiazolyl, oxadiazolyl, furanyl, quinolinyl, isoquinolinyl, benzoxazolyl, benzimidazolyl, and benzothiazolyl.

The aliphatic and aromatic groups are substituted with an appropriate number of pendant hydrophilic and/or charged groups so as to provide the resulting hydrogel with the properties described herein. In some aspects, the pendant hydrophilic group is one or more (e.g., 2, 3, 4, 5, 6, 7, 8, 9, 10 or more) hydroxyl groups. In various aspects, the pendant hydrophilic group is one or more (e.g., 2, 3, 4, 5, 6, 7, 8, 9, 10 or more) amino groups. In some cases, the pendant hydrophilic group is one or more (e.g., 2, 3, 4, 5, 6, 7, 8, 9, 10 or more) carboxylate groups. For example, the aliphatic group can include polyacrylic acid. In some cases, the pendant hydrophilic group is one or more (e.g., 2, 3, 4, 5, 6, 7, 8, 9, 10 or more) sulfonate groups. In some cases, the pendant hydrophilic group is one or more (e.g., 2, 3, 4, 5, 6, 7, 8, 9, 10 or more) phosphate groups. In some aspects, the pendant hydrophilic group is one or more ammonium groups (e.g., tertiary and/or quaternary ammonium). In other aspects, the pendant hydrophilic group is one or more zwitterions (e.g., a betaine, such as poly(carboxybetaine (pCB) and ammonium phosphonates such as phosphatidylcholine).

In some aspects, the $R_2$ segment includes charged groups that are capable of binding to a counterion to ionically crosslink the polymer the polymer network and form ionomers. In these aspects, for example, $R_2$ is an aliphatic or aromatic group having pendant amino, carboxylate, sulfonate, phosphate, ammonium, zwitterionic groups, or combinations thereof.

In various cases, the pendant hydrophilic group is at least one polyether, such as two polyethers. In other cases, the pendant hydrophilic group is at least one polyester. In various cases, the pendant hydrophilic group is polylactone (e.g., polyvinylpyrrolidone). Each carbon atom of the pendant hydrophilic group can optionally be substituted with, e.g., $C_{1-6}$ alkyl. In some of these aspects, the aliphatic and aromatic groups can be graft polymers, wherein the pendant groups are homopolymers (e.g., polyethers, polyesters, polyvinylpyrrolidone).

In some preferred aspects, the pendant hydrophilic group is a polyether (e.g., polyethylene oxide and polyethylene glycol), polyvinylpyrrolidone, polyacrylic acid, or combinations thereof.

The pendant hydrophilic group can be bonded to the aliphatic group or aromatic group through a linker. The linker can be any bifunctional small molecule (e.g., $C_{1-20}$) capable of linking the pendant hydrophilic group to the aliphatic or aromatic group. For example, the linker can include a diisocyanate, as previously described herein, which when linked to the pendant hydrophilic group and to the aliphatic or aromatic group forms a carbamate bond. In some aspects, the linker can be 4,4'-diphenylmethane diisocyanate (MDI), as shown below.

(Formula 3)

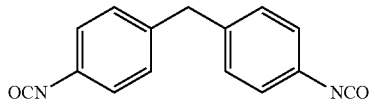

In some exemplary aspects, the pendant hydrophilic group is polyethylene oxide and the linking group is MDI, as shown below.

(Formula 4)

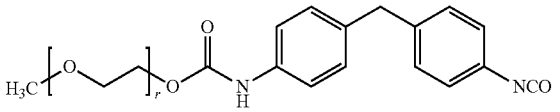

In some cases, the pendant hydrophilic group is functionalized to enable it to bond to the aliphatic or aromatic group, optionally through the linker. In various aspects, for example, when the pendant hydrophilic group includes an alkene group, which can undergo a Michael addition with a sulfhydryl-containing bifunctional molecule (i.e., a molecule having a second reactive group, such as a hydroxyl group or amino group), to result in a hydrophilic group that can react with the polymer backbone, optionally through the linker, using the second reactive group. For example, when the pendant hydrophilic group is polyvinylpyrrolidone, it can react with the sulfhydryl group on mercaptoethanol to result in hydroxyl-functionalized polyvinylpyrrolidone, as shown below.

(Formula 5)

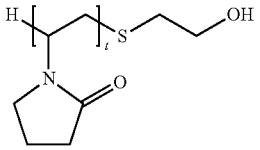

In some of the aspects disclosed herein, at least one $R_2$ segment is polytetramethylene oxide. In other exemplary aspects, at least one $R_2$ segment can be an aliphatic polyol functionalized with polyethylene oxide or polyvinylpyrrolidone, such as the polyols described in E.P. Patent No. 2 462 908. For example, the $R_2$ segment can be derived from the reaction product of a polyol (e.g., pentaerythritol or 2,2,3-trihydroxypropanol) and either MDI-derivatized methoxypolyethylene glycol (to obtain compounds as shown in Formulas 6 or 7) or with MDI-derivatized polyvinylpyrrolidone (to obtain compounds as shown in Formulas 8 or 9) that had been previously been reacted with mercaptoethanol, as shown below, wherein:

a is 1 to 10 or larger (e.g., 1, 2, 3, 4, 5, 6, 7, 8, 9, or 10);

each $R^4$ independently is hydrogen, $C_{1-18}$ alkyl, $C_{2-18}$ alkenyl, aryl, or polyether; and each $R^5$ independently is $C_{1-10}$alkylene, polyether, or polyurethane.

In some aspects, each $R^4$ independently is H, $C_{1-10}$ alkyl, $C_{2-10}$alkenyl, $C_{1-6}$aryl, polyethylene, polypropylene, or polybutylene. For example, each $R^4$ can independently be selected from the group consisting of methyl, ethyl, n-propyl, isopropyl, n-butyl, isobutyl, s-butyl, t-butyl, ethenyl, propenyl, phenyl, and polyethylene.

In various aspects, each $R^5$ independently is $C_{1-10}$alkylene (e.g., methylene, ethylene, propylene, butylene, pentylene, hexylene, heptylene, octylene, nonylene, or decylene). In other cases, each $R^5$ is polyether (e.g., polyethylene, polypropylene, or polybutylene). In various cases, each $R^5$ is polyurethane.

In some aspects, the hydrogel includes a crosslinked polymeric network that includes copolymer chains that are derivatives of polyurethane. This crosslinked polymeric network can be produced by polymerizing one or more isocyanates with one or more polyamino compounds, polysulfhydryl compounds, or combinations thereof, as shown in Formulas 11 and 12, below:

(Formula 6)

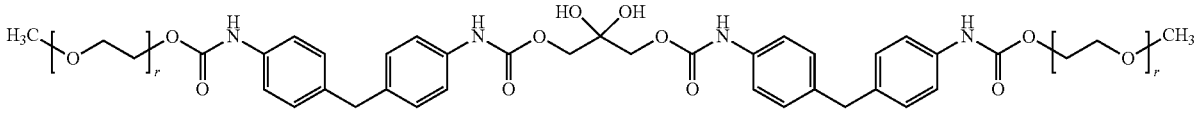

(Formula 7)

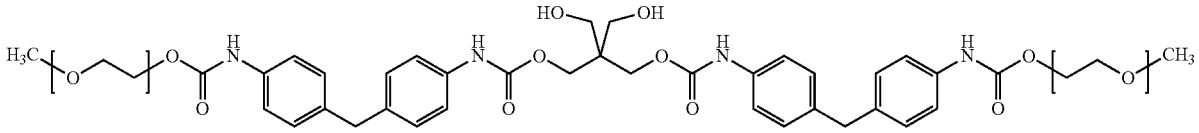

(Formula 8)

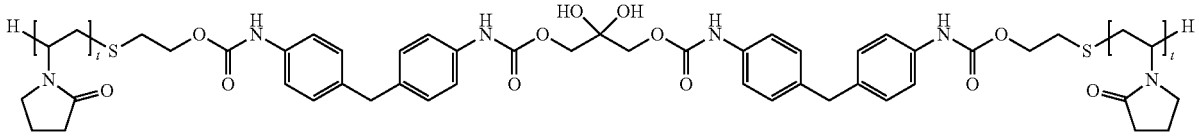

(Formula 9)

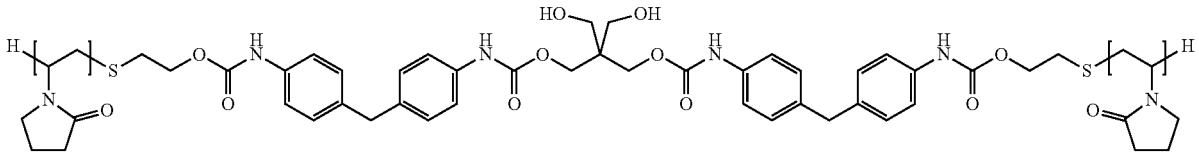

In various cases, at least one $R_2$ is a polysiloxane. In these cases, $R_2$ can be derived from a silicone monomer of Formula 10, such as a silicone monomer disclosed in U.S. Pat. No. 5,969,076, which is hereby incorporated by reference:

(Formula 10)

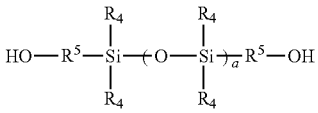

(Formula 11)

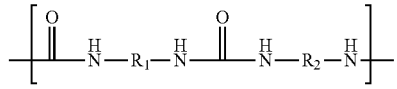

(Formula 12)

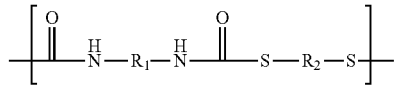

wherein the variables are as described above. Additionally, the isocyanates can also be chain extended with one or more polyamino or polythiol chain extenders to bridge two or more isocyanates, such as previously described for the polyurethanes of Formula 2.

In some aspects, the polyurethane hydrogel is composed of MDI, PTMO, and 1,4-butylene glycol, as described in U.S. Pat. No. 4,523,005, which is hereby incorporated by reference in its entirety.

In some aspects, the polyurethane hydrogel is physically crosslinked through e.g., nonpolar or polar interactions between the urethane or carbamate groups on the polymers (the hard segments), and is a thermoplastic polyurethane (TPU), or specifically, a hydrophilic thermoplastic polyurethane. In these aspects, component $R_1$ in Formula 1, and components $R_1$ and $R_3$ in Formula 2, forms the portion of the polymer often referred to as the "hard segment", and component $R_2$ forms the portion of the polymer often referred to as the "soft segment". In these aspects, the soft segment can be covalently bonded to the hard segment.

Commercially available thermoplastic polyurethane hydrogels suitable for the present use include, but are not limited to those under the tradename "TECOPHILIC", such as TG-500, TG-2000, SP-80A-150, SP-93A-100, SP-60D-60 (Lubrizol, Countryside, Ill.), "ESTANE" (e.g., ALR G 500; Lubrizol, Countryside, Ill.).

In various aspects, the polyurethane hydrogel is covalently crosslinked, as previously described herein.

In some aspects, the polyamide segment of the polyamide hydrogel comprises or consists essentially of a polyamide. The polyamide hydrogel can be formed from the polycondensation of a polyamide prepolymer with a hydrophilic prepolymer to form a block copolyamide.

In some aspects, the polyamide segment of the polyamide hydrogel can be derived from the condensation of polyamide prepolymers, such as lactams, amino acids, and/or diamino compounds with dicarboxylic acids, or activated forms thereof. The resulting polyamide segments include amide linkages (—(CO)NH—). The term "amino acid" refers to a molecule having at least one amino group and at least one carboxyl group. Each polyamide segment of the polyamide hydrogel can be the same or different.

In some aspects, the polyamide segment is derived from the polycondensation of lactams and/or amino acids, and includes an amide segment having a structure shown in Formula 13, below, wherein $R_6$ is the segment of the block copolymer derived from the lactam or amino acid, and $R_2$ is the segment derived from a hydrophilic prepolymer:

(Formula 13)

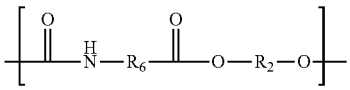

In some aspects, $R_6$ is derived from a lactam. In some cases, $R_6$ is derived from a $C_{3-20}$ lactam, or a $C_{4-15}$ lactam, or a $C_{6-12}$ lactam. For example, $R_6$ can be derived from caprolactam or laurolactam. In some cases, $R_6'$ is derived from one or more amino acids. In various cases, $R_6$ is derived from a $C_{4-25}$ amino acid, or a $C_{5-20}$ amino acid, or a $C_{8-15}$ amino acid. For example, $R_6'$ can be derived from 12-aminolauric acid or 11-aminoundecanoic acid.

In some cases, Formula 13 includes a polyamide-polyether block copolymer segment, as shown below:

(Formula 14)

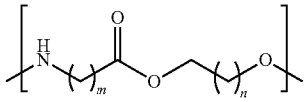

wherein m is 3-20, and n is 1-8. In some exemplary aspects, m is 4-15, or 6-12 (e.g., 6, 7, 8, 9, 10, 11, or 12), and n is 1 2, or 3. For example, m can be 11 or 12, and n can be 1 or 3.

In various aspects, the polyamide segment of the polyamide hydrogel is derived from the condensation of diamino compounds with dicarboxylic acids, or activated forms thereof, and includes an amide segment having a structure shown in Formula 15, below, wherein $R_7$ is the segment of the block copolymer derived from the diamino compound, $R_8$ is the segment derived from the dicarboxylic acid compound, and $R_2$ is the segment derived from a hydrophilic prepolymer:

(Formula 15)

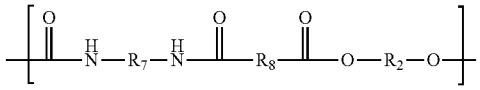

In some aspects, $R_7$ is derived from a diamino compound that includes an aliphatic group having $C_{4-15}$ carbon atoms, or $C_{5-10}$ carbon atoms, or $C_{6-9}$ carbon atoms. In some aspects, the diamino compound includes an aromatic group, such as phenyl, naphthyl, xylyl, and tolyl. Suitable diamino compounds include, but are not limited to, hexamethylene diamine (HMD), tetramethylene diamine, trimethyl hexamethylene diamine (TMD), m-xylylene diamine (MXD), and 1,5-pentamine diamine. In various aspects, $R_8$ is derived from a dicarboxylic acid or activated form thereof, includes an aliphatic group having $C_{4-15}$ carbon atoms, or $C_{5-12}$ carbon atoms, or $C_{6-10}$ carbon atoms. In some cases, the dicarboxylic acid or activated form thereof includes an aromatic group, such as phenyl, naphthyl, xylyl, and tolyl. Suitable carboxylic acids or activated forms thereof include, but are not limited to adipic acid, sebacic acid, terephthalic acid, and isophthalic acid. In some aspects, the copolymer chains are substantially free of aromatic groups.

In some preferred aspects, each polyamide segment is independently derived from a polyamide prepolymer selected from the group consisting of 12-aminolauric acid, caprolactam, hexamethylene diamine and adipic acid.

Additionally, the polyamide hydrogels can also be chain extended with one or more polyamino, polycarboxyl (or derivatives thereof), or amino acid chain extenders, as previously described herein. In some aspects, the chain extender can include a diol, dithiol, amino alcohol, aminoalkyl mercaptan, hydroxyalkyl mercaptan, a phosphite or a bisacyllactam compound (e.g., triphenylphosphite, N,N'-terephthaloyl bis-laurolactam, and diphenyl isophthalate).

Each component $R_2$ of Formula 13 and 15 independently is polyether, polyester, polycarbonate, an aliphatic group, or an aromatic group, wherein the aliphatic group or aromatic group is substituted with one or more pendant hydrophilic groups, as previously described herein, wherein the pendant group can optionally be bonded to the aliphatic or aromatic group through a linker, as previously described herein.

In some preferred aspects, $R_2$ is derived from a compound selected from the group consisting of polyethylene oxide (PEO), polypropylene oxide (PPO), polytetrahydrofuran (PTHF), polytetramethylene oxide (PTMO), a polyethylene oxide-functionalized aliphatic or aromatic group, a polyvinylpyrrolidone-functionalized aliphatic of aromatic group, and combinations thereof. In various cases, $R_2$ is derived from a compound selected from the group consisting of polyethylene oxide (PEO), polypropylene oxide (PPO), polytetramethylene oxide (PTMO), a polyethylene oxide-functionalized aliphatic or aromatic group, and combinations thereof. For example, $R_2$ can be derived from a compound selected from the group consisting of polyethylene oxide (PEO), polytetramethylene oxide (PTMO), and combinations thereof.

In some aspects, the polyamide hydrogel is physically crosslinked through, e.g., nonpolar or polar interactions between the polyamide groups on the polymers, and is a thermoplastic polyamide, or in particular, a hydrophilic thermoplastic polyamide. In these aspects, component $R_6$ in Formula 13 and components $R_7$ and $R_8$ in Formula 15 form the portion of the polymer often referred to as the "hard segment", and component $R_2$ forms the portion of the polymer often referred to as the "soft segment". Therefore, in some aspects, the hydrogel or crosslinked polymeric network can include a physically crosslinked polymeric network having one or more polymer chains with amide linkages.

In some aspects, the hydrogel or crosslinked polymeric network includes plurality of block copolymer chains, wherein at least a portion of the block copolymer chains each include a polyamide block and a hydrophilic block, (e.g., a polyether block) covalently bonded to the polyamide block to result in a thermoplastic polyamide block copolymer hydrogel (i.e., a polyamide-polyether block copolymer). In these aspects, the polyamide segments can interact with each other to form the crystalline region. Therefore, the polyamide block copolymer chains can each comprise a plurality of polyamide segments forming crystalline regions with other polyamide segments of the polyamide block copolymer chains, and a plurality of hydrophilic segments covalently bonded to the polyamide segments.

In some aspects, the polyamide is polyamide-11 or polyamide-12 and the polyether is selected from the group consisting of polyethylene oxide, polypropylene oxide, and polytetramethylene oxide. Commercially available thermoplastic polyamide hydrogels suitable for the present use include those under the tradename "PEBAX" (e.g., "PEBAX MH1657" and "PEBAX MV1074") from Arkema, Inc., Clear Lake, Tex.), and "SERENE" coating (Sumedics, Eden Prairie, Minn.).

In various aspects, the polyamide hydrogel is covalently crosslinked, as previously described herein.

In some aspects, the hydrogel comprises or consists essentially of a polyolefin hydrogel. The polyolefin hydrogel can be formed through free radical, cationic, and/or anionic polymerization by methods well known to those skilled in the art (e.g., using a peroxide initiator, heat, and/or light).

In some aspects, the hydrogel or crosslinked polymeric network can include one or more, or a plurality, of polyolefin chains. For instance, the polyolefin can include polyacrylamide, polyacrylate, polyacrylic acid and derivatives or salts thereof, polyacrylohalide, polyacrylonitrile, polyallyl alcohol, polyallyl ether, polyallyl ester, polyallyl carbonate, polyallyl carbamate, polyallyl sulfone, polyallyl sulfonic acid, polyallyl amine, polyallyl cyanide, polyvinyl ester, polyvinyl thioester, polyvinyl pyrrolidone, polyα-olefin, polystyrene, and combinations thereof. Therefore, the polyolefin can be derived from a monomer selected from the group consisting of acrylamide, acrylate, acrylic acid and derivatives or salts thereof, acrylohalide, acrylonitrile, allyl alcohol, allyl ether, allyl ester, allyl carbonate, allyl carbamate, allyl sulfone, allyl sulfonic acid, allyl amine, allyl cyanide, vinyl ester, vinyl thioester, vinyl pyrrolidone, α-olefin, styrene, and combinations thereof.

In some aspects, the polyolefin is derived from an acrylamide. Suitable acrylamides can include, but are not limited to, acrylamide, methacrylamide, ethylacrylamide, N,N-dimethylacrylamide, N-isopropylacrylamide, N-tert-butylacrylamide, N-isopropylmethacrylamide, N-phenylacrylamide, N-diphenylmethylacrylamide, N-(triphenylmethyl)methacrylamide, N-hydroxyethyl acrylamide, 3-acryloylamino-1-propanol, N-acryloylamido-ethoxyethanol, N-[tris(hydroxymethyl)methyl]acrylamide, N-(3-methoxypropyl) acrylamide, N-[3-(dimethylamino)propyl]methacrylamide, (3-acrylamidopropyl)trimethylammonium chloride, diacetone acrylamide, 2-acrylamido-2-methyl-1-propanesulfonic acid, salts of 2-acrylamido-2-methyl-1-propanesulfonic acid, 4-acryloylmorpholine, and combinations thereof. For example, the acrylamide prepolymer can be acrylamide or methacrylamide.

In some cases, the polyolefin is derived from an acrylate (e.g., acrylate and/or alkylacrylate). Suitable acrylates include, but are not limited to, methyl acrylate, ethyl acrylate, propyl acrylate, isopropyl acrylate, n-butyl acrylate, isobutyl acrylate, tert-butyl acrylate, hexyl acrylate, isooctyl acrylate, isodecyl acrylate, octadecyl acrylate, lauryl acrylate, 2-ethylhexyl acrylate, 4-tert-butylcyclohexyl acrylate, 3,5,5-trimethylhexyl acrylate, isobornyl acrylate, vinyl methacrylate, allyl methacrylate, methyl methacrylate, ethyl methacrylate, butyl methacrylate, isobutyl methacrylate, tert-butyl methacrylate, hexyl methacrylate, 2-ethylhexyl methacrylate, isodecyl methacrylate, lauryl methacrylate, stearyl methacrylate, cyclohexyl methacrylate, 3,3,5-trimethylcyclohexyl methacrylate, combinations thereof, and the like. For example, acrylate prepolymer can be methyl acrylate, ethyl methacrylate, or 2-hydroxyethyl methacrylate.

In some cases, the polyolefin is derived from an acrylic acid or a derivative or salt thereof. Suitable acrylic acids, but are not limited to acrylic acid, sodium acrylate, methacrylic acid, sodium methacrylate, 2-ethylacrylic acid, 2-propylacrylic acid, 2-bromoacrylic acid, 2-(bromomethyl)acrylic acid, 2-(trifluoromethyl)acrylic acid, acryloyl chloride, methacryloyl chloride, and 2-ethylacryloyl chloride.

In various aspects, the polyolefin can be derived from an allyl alcohol, allyl ether, allyl ester, allyl carbonate, allyl carbamate, allyl sulfone, allyl sulfonic acid, allyl amine, allyl cyanide, or a combination thereof. For example, the polyolefin segment can be derived from allyloxyethanol, 3-allyloxy-1,2-propanediol, allyl butyl ether, allyl benzyl ether, allyl ethyl ether, allyl phenyl ether, allyl 2,4,6-tribromophenyl ether, 2-allyloxybenzaldehyde, 2-allyloxy-2-hydroxybenzophenone, allyl acetate, allyl acetoacetate, allyl chloroacetate, allylcyanoacetate, allyl 2-bromo-2-methylpropionate, allyl butyrate, allyltrifluoroacetae, allyl methyl carbonate, tert-butyl N-allylcarbamate, allyl methyl sulfone, 3-allyloxy-2-hydroxy-1-propanesulfonic acid, 3-allyloxy-2-hydroxy-1-propanesulfonic acid sodium salt, allylamine, an allylamine salt, and allyl cyanide.

In some cases, the polyolefin can be derived from a vinyl ester, vinyl thioester, vinyl pyrrolidone (e.g., N-vinyl pyrrolidone), and combinations thereof. For example, the vinyl monomer can be vinyl chloroformate, vinyl acetate, vinyl decanoate, vinyl neodecanoate, vinyl neononanoate, vinylpivalate, vinyl propionate, vinyl stearate, vinyl valerate, vinyl trifluoroacetate, vinyl benzoate, vinyl 4-tert-butylbenzoate, vinyl cinnamate, butyl vinyl ether, tert-butyl vinyl ether, cyclohexyl vinyl ether, dodecyl vinyl ether, ethylene glycol vinyl ether, 2-ethylhexyl vinyl ether, ethyl vinyl ether, ethyl-1-propenyl ether, isobutyl vinyl ether, propyl vinyl ether, 2-chloroethyl vinyl ether, 1,4-butanediol vinyl ether, 1,4-cyclohexanedimethanol vinyl ether, di(ethylene glycol) vinyl ether, diethyl vinyl orthoformate, vinyl sulfide, vinyl halide, and vinyl chloride.

In some aspects, the polyolefin can be derived from an alpha-olefin, such as 1-octene, 1-nonene, 1-decene, 1-undecene, 1-dodecene, 1-tridecene, 1-tetradecene, 1-pentadecene, 1-hexadecene, 1-pentadecene, 1-heptadecene, and 1-octadecene.

In various cases, the polyolefin segment containing $R_7$ can be derived from a styrene. Suitable styrene monomers include styrene, α-bromostyrene, 2,4-diphenyl-4-methyl-1-pentene, α-methylstyrene, 4-acetoxystyrene, 4-benzhydrylstyrene, 4-tert-butylstyrene, 2,4-dimethylstyrene, 2,5-dimethylstyrene, 2-methylstyrene, 3-methylstyrene, 4-methylstyrene, 2-(trifluoromethyl)styrene, 3-(trifluoromethyl)styrene, 4-(trifluoromethyl)styrene, 2,4,6-trimethylstyrene, vinylbenzyl chloride, 4-benzyloxy-3-methoxystyrene, 4-tert-butoxystyrene, 3,4-dimethoxystyrene, 4-ethoxystyrene, 4-vinylanisole, 2-bromostyrene, 3-bromostyrene, 4-bromosytrene, 4-chloro-α-methylstyrene, 2-chlorostyrene, 3-chlorostyrene, 4-chlorostyrene, 2,6-dichlorostyrene, 2,6-difluorostyrene, 2-fluorostyrene, 3-fluorostyrene, 4-fluorostyrene, 2,3,4,5,6-pentafluorostyrene, N,N-dimethylvinylbenzylamine, 2-isopropenylaniline, 4-[N-(methylaminoethyl)aminomethyl]styrene, 3-vinylaniline, 4-vinylaniline, (vinylbenzyl)trimethylammonium chloride, 4-(diphenylphosphino)styrene, 3-isopropenyl-α,α-dimethylbenzyl isocyanate, 3-nitrostyrene, 9-vinylanthracene, 2-vinylnaphthalene, 4-vinylbenzocyclobutene, 4-vinylbiphenyl, and vinylbenzoic acid.

In some aspects, the polyolefin comprises a hydrophilic portion. The hydrophilic portion of the polyolefin hydrogel can be pendant to the polyolefin backbone, or the hydrophilic portion can function as a covalent crosslinker of the polyolefin hydrogel. In some aspects, the hydrophilic portion of the polyolefin hydrogel includes a pendant polyether, polyester, polycarbonate, hydroxyl, lactone (e.g., pyrrolidone), amino, carboxylate, sulfonate, phosphate, ammonium (e.g., tertiary and quaternary ammonium), zwitterion group (e.g., a betaine, such as poly(carboxybetaine (pCB) and ammonium phosphonates such as phosphatidylcholine), or combinations thereof. Polyolefin hydrogels containing a pendant hydrophilic portion can be formed by copolymerizing a polyolefin monomer, as previously described, with a second polymer olefin monomer having a hydrophilic side chain, such as acrylic acid or polyvinylpyrrolidone).

In some aspects, the polyolefin hydrogel or crosslinked polymeric network includes a plurality of polyolefin chains wherein at least a portion of the polyolefin chains each comprise a first chain segment physically crosslinked to at least one other polyolefin chain of the plurality of polyolefin chains and one or more hydrophilic chain segments covalently bonded to the first chain segment.

In other aspects, the hydrophilic portion of the polyolefin hydrogel is a hydrophilic crosslinker. The crosslinker can include polyether, polyester, polycarbonate, hydroxyl, lactone (e.g., pyrrolidone), amino, carboxylate, sulfonate, phosphate, ammonium (e.g., tertiary and quaternary ammonium), a zwitterion (e.g., a betaine, such as poly(carboxybetaine (pCB) and ammonium phosphonates such as phosphatidylcholine), and combinations thereof. The hydrophilic crosslinker can be derived from a molecule having at least two ethylenically-unsaturated groups, such as a polyethylene glycol dimethacrylate.

Suitable commercially available polyolefin films include, but are not limited to the "POLYOX" product line by Dow Chemical, Midland Mich., and styrenic block co-polymers. Examples of styrenic co-polymers include, but are not limited to TPE-s (e.g., styrene-butadiene-styrene (SBS) block copolymers, such as "SOFPRENE" and styrene-ethylene-butylene-styrene (SEBS) block copolymer, such as "LAPRENE", by SO.F.TER. GROUP, Lebanon, Tenn.); thermoplastic copolyester elastomers (e.g., thermoplastic elastomer vulconates (TPE-v or TPV)), such as "FORPRENE" by SO.F.TER. GROUP), "TERMOTON-V" by Termopol, Istanbul Turkey; and TPE block copolymers, such as "SANTOPRENE" (ExxonMobil, Irving, Tex.).

In some aspects, the polyolefin prepolymer described above is co-polymerized with a silicone prepolymer to form a silicone hydrogel. In these aspects, the silicone prepolymer, the polyolefin prepolymer, or both can function as the crosslinker.

Examples of silicone monomers include, but are not limited to, 3-methacryloxypropyl tris(trimethylsiloxy)silane (TRIS), and monomethacryloxypropyl terminated polydimethylsiloxane (mPDMS), m vinyl[3-[3,3,3-trimethyl-1,1bis (trimethylsiloxy)-disiloxanyl]propyl]carbamate, 3-methacryloxypropyl-bis(trimethylsiloxy)methyl silane, and methacryloxypropylpentamethyl disiloxane.

As discussed above, the film material can also optionally include one or more additives, such as antioxidants, colorants, stabilizers, anti-static agents, wax packages, anti-blocking agents, crystal nucleating agents, melt strength enhancers, anti-stain agents, stain blockers, hydrophilicity-enhancing additives, and combinations thereof.

Examples of particularly suitable additives include hydrophilicity-enhancing additives, such as one or more superabsorbent polymers (e.g., superabsorbent polyacrylic acid or copolymers thereof). Examples of hydrophilicity-enhancing additives include those commercially available under the tradenames "CREASORB" or "CREABLOCK" by Evonik, Mobile, Ala., "HYSORB" by BASF, Wyandotte, Mich., "WASTE LOCK PAM" by $M^2$ Polymer Technologies, Inc., Dundee Township, Ill., and "AQUA KEEP" by Sumitomo Seika, New York, N.Y. The incorporation of the hydrophilicity-enhancing additive can assist the hydrogel by increasing the water uptake rate and/or capacity for the film material. Examples of suitable concentrations of the hydrophilicity-enhancing additive in the film material range from 0.1% to 15% by weight, from 0.5% to 10% by weight, or from 1% to 5% by weight, based on the total weight of the film material.

In some aspects, the material can define an exterior or externally-facing surface of the article. Alternatively, a water-permeable membrane can define the exterior or externally-facing surface of the article, and can be in direct contact with the material. For example, at least a portion of the exterior surface of the article can be defined by a first side of the water-permeable membrane, with the material present between the backing plate/article substrate and the membrane.

The level of water permeability of the water-permeable membrane is preferably sufficient for water to rapidly partition from the exterior surface of the article (i.e., the first side of the membrane), across the second side of the membrane, and into the material. For example, the level of water permeability of the water-permeable membrane can be sufficient for a sample of the article obtained in accordance with the Footwear Sampling Procedure to have a water uptake capacity of greater than 40% by weight at 24 hours and/or at 1 hour.

The articles of footwear of the present disclosure can be manufactured using a variety of different footwear manufacturing techniques. For example, the material (e.g., the material) and the backing plate or substrate can be formed using methods such as injection molding, cast molding, thermoforming, vacuum forming, extrusion, spray coating, and the like.

In a first aspect, the article is formed with the use of a co-extruded article plate. In this case, the film material can be co-extruded with a thermoplastic material used to form a thin backing substrate, where the resulting co-extrudate can be provided in a web or sheet form. The web or sheet can then be placed in a vacuum thermoforming tool to produce the three-dimensional geometry of the article externally-facing side (referred to as an article face precursor). The backing substrate provides a first function in this step by creating a structural support for the relatively thinner and weaker material. The article face precursor can then be trimmed to form its perimeter and orifices to receive traction elements, thereby providing an article face.

The article face can then be placed in a mold cavity, where the material is preferably positioned away from the injection sprues. Another thermoplastic material can then be back injected into the mold to bond to the backing substrate, opposite of the material. This illustrates the second function of the backing substrate, namely to protect the material from the injection pressure. The injected thermoplastic material can be the same or different from the material used to produce the backing substrate. Preferably, they include the same or similar materials (e.g., both being thermoplastic polyurethanes). As such, the backing substrate and the injected material in the mold form the article backing plate, which is secured to the material (during the co-extrusion step).

In a second aspect, the article is formed with the use of injection molding. In this case, a substrate material is preferably injected into a mold to produce the article backing plate. The article backing plate can then be back injected with the film material to produce the material bonded to the article backing plate.

In either aspect, after the article is manufactured, it can be directly or indirectly secured to a footwear upper to provide the article of footwear of the present disclosure. In particular, material can function as a externally-facing surface of the article, which is positioned on the opposite side of the article backing plate from the upper.

Property Analysis and Characterization Procedure

Various properties can be determined for materials of footwear according to the following methodologies.

1. Sampling Procedures

As mentioned above, it has been found that when the material is secured to another substrate, the interfacial bond can restrict the extent that the material can take up water and/or swell. As such, various properties of the material can be characterized using samples prepared with the following sampling procedures:

A. Footwear Sampling Procedure

This procedure can be used to obtain a sample of the material when the material is a component of a footwear article or article of footwear (e.g., bonded to an article substrate, such as an article backing plate). An article sample including the material in a non-wet state (e.g., at 25° C. and 20% relative humidity) is cut from the article of footwear using a blade. This process is performed by separating the article from an associated footwear upper, and removing any materials from the article top surface (e.g., corresponding to the top surface 142) that can uptake water and potentially skew the water uptake measurements of the material. For example, the article top surface can be skinned, abraded, scraped, or otherwise cleaned to remove any upper adhesives, yarns, fibers, foams, and the like that could potentially take up water themselves.

The resulting sample includes the material and any article substrate bonded to the material, and maintains the interfacial bond between the material and the associated article substrate. As such, this test can simulate how the material will perform as part of an article of footwear. Additionally, this sample is also useful in cases where the interfacial bond between the material and the article substrate is less defined, such as where the material of the material is highly diffused into the material of the article substrate (e.g., with a concentration gradient).

The sample is taken at a location along the article that provides a substantially constant film thickness for the material (within +/−10% of the average film thickness), such as in a forefoot region, midfoot region, or a heel region of the article, and has a surface area of 4 square centimeters ($cm^2$). In cases where the material is not present on the article in any segment having a 4 $cm^2$ surface area and/or where the film thickness is not substantially constant for a segment having a 4 $cm^2$ surface area, sample sizes with smaller cross-sectional surface areas can be taken and the area-specific measurements are adjusted accordingly.

B. Co-Extruded Film Sampling Procedure

This procedure can be used to obtain a sample of an material when the material is co-extruded onto a backing substrate. The backing substrate is produced from a material that is compatible with the material of the material, such as a material used to form an article backing plate for the material.

It has been found that samples taken from co-extruded materials are suitable substitutes to samples taken from articles of footwear. Additionally, this sample is also useful in cases where the interfacial bond between the material and the backing substrate is less defined, such as where the material of the material is highly diffused into the material of the backing substrate (e.g., with a concentration gradient).

In this case, the material is co-extruded with the backing substrate as a web or sheet having a substantially constant film thickness for the material (within +/−10% of the average film thickness), and cooled to solidify the resulting web or sheet. A sample of the article-film secured to the backing substrate is then cut from the resulting web or sheet, with a sample size surface area of 4 $cm^2$, such that the material of the resulting sample remains secured to the backing substrate.

C. Neat Film Sampling Procedure

This procedure can be used to obtain a sample of a material when the material is isolated in a neat form (i.e., without any bonded substrate). In this case, the material is extruded as a web or sheet having a substantially constant film thickness for the material (within +/−10% of the average film thickness), and cooled to solidify the resulting web or sheet. A sample of the material having a surface area of 4 $cm^2$ is then cut from the resulting web or sheet.

Alternatively, if a source of the material is not available in a neat form, the material can be cut from an article substrate of a footwear article, or from a backing substrate of a co-extruded sheet or web, thereby isolating the material. In either case, a sample of the material having a surface area of 4 $cm^2$ is then cut from the resulting isolated film.

D. Neat Material Sampling Procedure

This procedure can be used to obtain a sample of a material used to form the material. In this case, the material is provided in media form, such as flakes, granules, powders, pellets, and the like. If a source of the material is not available in a neat form, the material can be cut, scraped, or ground from an article substrate of a footwear article or from a backing substrate of a co-extruded sheet or web, thereby isolating the material.

E. Apparel Sampling Procedure

This procedure can be used to obtain a sample of the material when the material is present on a component of an article of apparel (e.g., when the material is affixed to a substrate, or when the material is integrally formed in the component, such as when the material is present in the form of a filament or yarn used to construct the component of apparel). A sample including the material in a dry state (e.g., at 25° C. and 20% relative humidity) is cut from the article of apparel using a blade. This process is performed by separating the component of the article of apparel from an associated component of the article of apparel. For example, if the material is present on a sleeve of a shirt, the sleeve component can be removed from the rest of the garment, and then the sample can be removed from the sleeve component.

If possible, any remaining substances can be removed from the second surface of the component (e.g., the surface opposing the externally facing surface which comprises the material) that can take up water and potentially skew the water uptake measurements of the material. For example, any padding or additional layers which are not externally-facing during wear can be removed from the second side of the sample. For example, if appropriate, the second surface can be skinned, abraded, scraped, or otherwise cleaned to remove any upper adhesives, yarns, fibers, foams, and the like that could potentially take up water themselves.

The resulting sample includes the material present on the first side of the component (the side configured to be externally-facing during use) and any substrate affixed to the component, and, if one is present, maintains the interfacial bond between the material and the associated component substrate. As such, this test can simulate how the material will perform as part of an article of apparel. Additionally, this sample is also useful in cases where the interfacial bond between the material and the component substrate is less defined, such as where the material is highly diffused into the component substrate (e.g., with a concentration gradient), as well as cases where the material is integrally formed with the component (e.g., the component is formed from a textile which includes yarn comprising the material).

The sample is taken at a location along the component of the article of apparel that provides a substantially constant thickness for the material (within +/−10% of the average material thickness present in the component), is taken from a portion of the component where soil would typically accumulate during wear, and has a surface area of 4 square centimeters ($cm^2$). In cases where the material is not present on the component in any segment having a 4 $cm^2$ surface area and/or where the material thickness is not substantially constant for a segment having a 4 $cm^2$ surface area, sample sizes with smaller cross-sectional surface areas can be taken and the area-specific measurements are adjusted accordingly.

F. Equipment Sampling Procedure

This procedure can be used to obtain a sample of the material when the material is present on a component of an article of sporting equipment (e.g., when the material is affixed to a substrate, or when the material is integrally formed in the component, such as when the material is present in the form of a filament or yarn used to construct the component of the article of sporting equipment). A sample including the material in a dry state (e.g., at 25° C. and 20% relative humidity) is cut from the article of sporting equipment using a blade. This process is performed by separating the component of the article of sporting equipment from an associated component of the article of sporting equipment. For example, if the material is present on a portion of a golf bag, the portion of the golf bag comprising the material can be removed from the rest of the golf bag, and then the sample can be removed from the portion of the golf bag comprising the material.

If possible, any remaining substances can be removed from the second surface of the component (e.g., the surface opposing the externally facing surface which comprises the material) that can take up water and potentially skew the water uptake measurements of the material. For example, any padding or additional layers which are not externally-facing during use can be removed from the second side of the sample. For example, if appropriate, the second surface can be skinned, abraded, scraped, or otherwise cleaned to remove any upper adhesives, yarns, fibers, foams, and the like that could potentially take up water themselves.

The resulting sample includes the material present on the first side of the component (the side configured to be externally-facing during use) and any substrate affixed to the component, and, if one is present, maintains the interfacial bond between the material and the associated component substrate. As such, this test can simulate how the material will perform as part of an article of sporting equipment. Additionally, this sample is also useful in cases where the interfacial bond between the material and the component substrate is less defined, such as where the material is highly diffused into the component substrate (e.g., with a concentration gradient), as well as cases where the material is integrally formed with the component (e.g., the component is formed from a textile which includes yarn comprising the material).

The sample is taken at a location along the component of the article of sporting equipment that provides a substantially constant thickness for the material (within +/−10% of the average material thickness present in the component), is taken from a portion of the component where soil would typically accumulate during wear, and has a surface area of 4 square centimeters ($cm^2$). In cases where the material is not present on the component in any segment having a 4 $cm^2$ surface area and/or where the material thickness is not substantially constant for a segment having a 4 $cm^2$ surface area, sample sizes with smaller cross-sectional surface areas can be taken and the area-specific measurements are adjusted accordingly.

The following test procedures are described with reference to materials and articles. However, the same tests can be applied to samples taken with the Apparel Sampling Procedure and the Equipment Sampling Procedure.

2. Water Uptake Capacity Test

This test measures the water uptake capacity of the material after a given soaking duration for a sample (e.g., taken with the above-discussed Footwear Sampling Procedure, Co-extruded Film Sampling Procedure, or the Neat Film Sampling Procedure). The sample is initially dried at 60° C. until there is no weight change for consecutive measurement intervals of at least 30 minutes apart (e.g., a 24-hour drying period at 60° C. is typically a suitable duration). The total weight of the dried sample ($Wt_{,sample,dry}$) is then measured in grams. The dried sample is then allowed to cool down to 25° C., and is fully immersed in a deionized water bath maintained at 25° C. After a given soaking duration, the sample is removed from the deionized water bath, blotted with a cloth to remove surface water, and the total weight of the soaked sample ($Wt_{,sample,wet}$) is measured in grams.

Any suitable soaking duration can be used, where a 24-hour soaking duration is believed to simulate saturation conditions for the materials of the present disclosure (i.e., the material will be in its saturated state). Accordingly, as used herein, the expression "having a water uptake capacity at 5 minutes of . . . " refers to a soaking duration of 5 minutes, having a water uptake capacity at 1 hour of . . . " refers to a soaking duration of 1 hour, the expression "having a water uptake capacity at 24 hours of . . . " refers to a soaking duration of 24 hours, and the like.

As can be appreciated, the total weight of a sample taken pursuant to the Footwear Sampling Procedure or the Co-extruded Film Sampling Procedure includes the weight of the material as dried or soaked ($Wt_{,film,dry}$ or $Wt_{,film,wet}$) and the weight of the article or backing substrate ($Wt_{,substrate}$). In order to determine a change in weight of the material due to water uptake, the weight of the substrate ($Wt_{,substrate}$) needs to be subtracted from the sample measurements.

The weight of the substrate ($Wt_{,substrate}$) is calculated using the sample surface area (e.g., 4 $cm^2$), an average measured thickness of the substrate in the sample, and the average density of the substrate material. Alternatively, if the density of the material for the substrate is not known or obtainable, the weight of the substrate ($Wt_{,substrate}$) is determined by taking a second sample using the same sampling procedure as used for the primary sample, and having the same dimensions (surface area and film/substrate thicknesses) as the primary sample. The material of the second sample is then cut apart from the substrate of the second sample with a blade to provide an isolated substrate. The isolated substrate is then dried at 60° C. for 24 hours, which can be performed at the same time as the primary sample drying. The weight of the isolated substrate ($Wt_{,substrate}$) is then measured in grams.

The resulting substrate weight ($Wt_{,substrate}$) is then subtracted from the weights of the dried and soaked primary sample ($Wt_{,sample,dry}$ and $Wt_{,sample}$,wet) to provide the weights of the material as dried and soaked ($W,t_{film,dry}$ and $Wt_{,film,wet}$), as depicted below by Equations 1 and 2:

$$Wt_{,film,dry}=Wt_{,sample,dry}-Wt_{,substrate} \quad \text{(Equation 1)}$$

$$Wt_{film,wet}=Wt_{sample,wet}-Wt_{substrate} \quad \text{(Equation 2)}$$

For material samples taken pursuant to the Neat Film Sampling Procedure, the substrate weight ($Wt_{,substrate}$) is zero. As such, Equation 1 collapses to $Wt_{,film,dry}=Wt_{,sample,dry}$, and Equation 2 collapses to $Wt_{,film,wet}=Wt_{,sample,wet}$.

The weight of the dried material ($Wt_{,film,dry}$) is then subtracted from the weight of the soaked material ($Wt_{,film,wet}$) to provide the weight of water that was taken up by the material, which is then divided by the weight of the dried material ($Wt_{,film,dry}$) to provide the water uptake capacity for the given soaking duration as a percentage, as depicted below by Equation 3:

$$\text{Water Uptake Capacity} = \frac{Wt_{,film,wet} - Wt_{,film,dry}}{Wt_{,film,dry}}(100\%) \quad \text{(Equation 3)}$$

For example, a water uptake capacity of 50% at 1 hour means that the soaked material weighed 1.5 times more than its dry-state weight after soaking for 1 hour, where there is a 1:2 weight ratio of water to material. Similarly, a water uptake capacity of 500% at 24 hours means that the soaked material weighed 5 times more than its dry-state weight after soaking for 24 hours, where there is a 4:1 weight ratio of water to material.

3. Water Uptake Rate Test

This test measures the water uptake rate of the material by modeling weight gain as a function of soaking time for a sample with a one-dimensional diffusion model. The sample can be taken with any of the above-discussed Footwear Sampling Procedure, Co-extruded Film Sampling Procedure, or the Neat Film Sampling Procedure. The sample is initially dried at 60° C. until there is no weight change for consecutive measurement intervals of at least 30 minutes apart (a 24-hour drying period at 60° C. is typically a suitable duration). The total weight of the dried sample ($Wt_{,sample,dry}$) is then measured in grams. Additionally, the average thickness of the material for the dried sample is measured for use in calculating the water uptake rate, as explained below.

The dried sample is then allowed to cooled down to 25° C., and is fully immersed in a deionized water bath maintained at 25° C. Between soaking durations of 1, 2, 4, 9, 16, and 25 minutes, the sample is removed from the deionized water bath, blotted with a cloth to remove surface water, and the total weight of the soaked sample ($Wt_{,sample,wet,t}$) is measured, where "t" refers to the particular soaking-duration data point (e.g., 1, 2, 4, 9, 16, or 25 minutes).

The exposed surface area of the soaked sample ($A_t$) is also measured with calipers for determining the specific weight gain, as explained below. The exposed surface area refers to the surface area that comes into contact with the deionized water when fully immersed in the bath. For samples obtained using the Footwear Sampling Procedure and the Co-extruded Film Sampling Procedure, the samples only have one major surface exposed. However, for samples obtained using the Neat Film Sampling Procedure, both major surfaces are exposed. For convenience, the surface areas of the peripheral edges of the sample are ignored due to their relatively small dimensions.

The measured sample is fully immersed back in the deionized water bath between measurements. The 1, 2, 4, 9, 16, and 25 minute durations refer to cumulative soaking durations while the sample is fully immersed in the deionized water bath (i.e., after the first minute of soaking and first measurement, the sample is returned to the bath for one more minute of soaking before measuring at the 2-minute mark).

As discussed above in the Water Uptake Capacity Test, the total weight of a sample taken pursuant to the Footwear Sampling Procedure or the Co-extruded Film Sampling Procedure includes the weight of the material as dried or soaked ($Wt_{,film,dry}$ or $Wt_{,film,wet,t}$) and the weight of the article or backing substrate ($Wt_{,substrate}$). In order to determine a weight change of the material due to water uptake, the weight of the substrate ($Wt_{,substrate}$) needs to be subtracted from the sample weight measurements. This can be accomplished using the same steps discussed above in the Water Uptake Capacity Test to provide the resulting material weights $Wt_{film,dry}$ and $Wt_{film,wet,t}$ for each soaking-duration measurement.

The specific weight gain ($Ws_{film,t}$) from water uptake for each soaked sample is then calculated as the difference between the weight of the soaked sample ($Wt_{film,wet,t}$) and the weight of the initial dried sample t ($Wt_{film,dry}$) where the resulting difference is then divided by the exposed surface area of the soaked sample ($A_t$), as depicted below by Equation 4:

$$Ws_{film,t} = \frac{Wt_{film,wet,t} - Wt_{film,dry}}{A_t} \quad \text{(Equation 4)}$$

where t refers to the particular soaking-duration data point (e.g., 1, 2, 4, 9, 16, or 25 minutes), as mentioned above.

The water uptake rate for the material is then determined as the slope of the specific weight gains ($Ws_{film,t}$) versus the square root of time (in minutes), as determined by a least squares linear regression of the data points. For the materials of the present disclosure, the plot of the specific weight gains ($Ws_{film,t}$) versus the square root of time (in minutes) provides an initial slope that is substantially linear (to provide the water uptake rate by the linear regression analysis). However, after a period of time depending on the thickness of the material, the specific weight gains will slow down, indicating a reduction in the water uptake rate, until the saturated state is reached. This is believed to be due to the water being sufficiently diffused throughout the material as the water uptake approaches saturation, and will vary depending on film thickness.

As such, for the material having an average dried film thickness (as measured above) less than 0.3 millimeters, only the specific weight gain data points at 1, 2, 4, and 9 minutes are used in the linear regression analysis. In these cases, the data points at 16 and 25 minutes can begin to significantly diverge from the linear slope due to the water uptake approaching saturation, and are omitted from the linear regression analysis. In comparison, for the material having an average dried film thickness (as measured above) of 0.3 millimeters or more, the specific weight gain data points at 1, 2, 4, 9, 16, and 25 minutes are used in the linear regression analysis. The resulting slope defining the water uptake rate for the sampled material has units of weight/(surface area-square root of time), such as grams/(meter$^2$-minutes$^{1/2}$).

Furthermore, some film or substrate surfaces can create surface phenomenon that quickly attract and retain water molecules (e.g., via surface hydrogen bonding or capillary action) without actually drawing the water molecules into the film or substrate. Thus, samples of these films or substrates can show rapid specific weight gains for the 1-minute sample, and possibly for the 2-minute sample. After that, however, further weight gain is negligible. As such, the linear regression analysis is only applied if the specific weight gain data points at 1, 2, and 4 minutes continue to show an increase in water uptake. If not, the water uptake rate under this test methodology is considered to be about zero grams/(meter$^2$-minutes$^{1/2}$).

4. Swelling Capacity Test

This test measures the swelling capacity of the material in terms of increases in film thickness and film volume after a given soaking duration for a sample (e.g., taken with the above-discussed Footwear Sampling Procedure, Co-extruded Film Sampling Procedure, or the Neat Film Sampling Procedure). The sample is initially dried at 60° C. until there is no weight change for consecutive measurement intervals of at least 30 minutes apart (a 24-hour drying period is typically a suitable duration). The film dimensions of the dried sample are then measured (e.g., thickness, length, and width for a rectangular sample; thickness and diameter for a circular sample, etc. . . . ). The dried sample is then fully immersed in a deionized water bath maintained at 25° C. After a given soaking duration, the sample is removed from the deionized water bath, blotted with a cloth to remove surface water, and the same film dimensions for the soaked sample are re-measured.

Any suitable soaking duration can be used. Accordingly, as used herein, the expressions "having a swelling thickness (or volume) increase at 5 minutes of . . . " refers to a soaking duration of 5 minutes, having a swelling thickness (or volume) increase at 1 hour of . . . " refers to a test duration of 1 hour, the expression "having a swelling thickness (or volume) increase at 24 hours of . . . " refers to a test duration of 24 hours, and the like.

The swelling of the material is determined by (i) an increase in the film thickness between the dried and soaked material, by (ii) an increase in the film volume between the dried and soaked material, or (iii) both. The increase in film thickness between the dried and soaked film is calculated by subtracting the measured film thickness of the initial dried film from the measured film thickness of the soaked film. Similarly, the increase in film volume between the dried and soaked film is calculated by subtracting the measured film volume of the initial dried film from the measured film volume of the soaked film. The increases in the film thickness and volume can also be represented as percentage increases relative to the dry-film thickness or volume, respectively.

5. Contact Angle Test

This test measures the contact angle of the material surface (or of the article surface) based on a static sessile drop contact angle measurement for a sample (e.g., taken with the above-discussed Footwear Sampling Procedure, Co-extruded Film Sampling Procedure, or the Neat Film Sampling Procedure). The contact angle refers to the angle at which a liquid interface meets a solid surface, and is an indicator of how hydrophilic the surface is.

For a dry test (i.e., to determine a dry-state contact angle), the sample is initially equilibrated at 25° C. and 20% humidity for 24 hours. For a wet test (i.e., to determine a wet-state contact angle), the sample is fully immersed in a deionized water bath maintained at 25° C. for 24 hours. After that, the sample is removed from the bath and blotted with a cloth to remove surface water, and clipped to a glass slide if needed to prevent curling.

The dry or wet sample is then placed on a moveable stage of a contact angle goniometer commercially available under the tradename "RAME-HART F290" from Rame-Hart Instrument Co., Succasunna, N.J. A 10-microliter droplet of deionized water is then placed on the sample using a syringe and automated pump. An image is then immediately taken of the droplet (before film can take up the droplet), and the contact angle of both edges of the water droplet are measured from the image. The decrease in contact angle between the dried and wet samples is calculated by subtracting the measured contact angle of the wet film from the measured contact angle of the dry film.

6. Coefficient of Friction Test

This test measures the coefficient of friction of the material surface (or of the article surface) for a sample (e.g., taken with the above-discussed Footwear Sampling Procedure, Co-extruded Film Sampling Procedure, or the Neat Film Sampling Procedure). For a dry test (i.e., to determine a dry-state coefficient of friction), the sample is initially equilibrated at 25° C. and 20% humidity for 24 hours. For a wet test (i.e., to determine a wet-state coefficient of friction), the sample is fully immersed in a deionized water bath maintained at 25° C. for 24 hours. After that, the sample is removed from the bath and blotted with a cloth to remove surface water.

The measurement is performed with an aluminum sled mounted on an aluminum test track, which is used to perform a sliding friction test for test sample on an aluminum surface of the test track. The test track measures 127 millimeters wide by 610 millimeters long. The aluminum sled measures 76.2 millimeters×76.2 millimeters, with a 9.5 millimeter radius cut into the leading edge. The contact area of the aluminum sled with the track is 76.2 millimeters×66.6 millimeters, or 5,100 square millimeters).

The dry or wet sample is attached to the bottom of the sled using a room temperature-curing two-part epoxy adhesive commercially available under the tradename "LOCTITE 608" from Henkel, Dusseldorf, Germany. The adhesive is used to maintain the planarity of the wet sample, which can curl when saturated. A polystyrene foam having a thickness of about 25.4 millimeters is attached to the top surface of the sled (opposite of the test sample) for structural support.

The sliding friction test is conducted using a screw-driven load frame. A tow cable is attached to the sled with a mount supported in the polystyrene foam structural support, and is wrapped around a pulley to drag the sled across the aluminum test track. The sliding or frictional force is measured using a load transducer with a capacity of 2,000 Newtons. The normal force is controlled by placing weights on top of the aluminum sled, supported by the polystyrene foam structural support, for a total sled weight of 20.9 kilograms (205 Newtons). The crosshead of the test frame is increased at a rate of 5 millimeters/second, and the total test displacement is 250 millimeters. The coefficient of friction is calculated based on the steady-state force parallel to the direction of movement required to pull the sled at constant velocity. The coefficient of friction itself is found by dividing the steady-state pull force by the applied normal force. Any transient value relating static coefficient of friction at the start of the test is ignored.

7. Storage Modulus Test

This test measures the resistance of the material to being deformed (ratio of stress to strain) when a vibratory or oscillating force is applied to it, and is a good indicator of film compliance in the dry and wet states. For this test, a sample is provided in neat form using the Neat Film Sampling Procedure, which is modified such that the surface area of the test sample is rectangular with dimensions of 5.35 millimeters wide and 10 millimeters long. The film thickness can range from 0.1 millimeters to 2 millimeters, and the specific range is not particularly limited as the end modulus result is normalized according to film thickness.

The storage modulus (E') with units of megaPascals (MPa) of the sample is determined by dynamic mechanical analysis (DMA) using a DMA analyzer commercially available under the tradename "Q800 DMA ANALYZER" from TA Instruments, New Castle, Del., which is equipped with a relative humidity accessory to maintain the sample at constant temperature and relative humidity during the analysis.

Initially, the thickness of the test sample is measured using calipers (for use in the modulus calculations). The test sample is then clamped into the DMA analyzer, which is operated at the following stress/strain conditions during the analysis: isothermal temperature of 25° C., frequency of 1 Hertz, strain amplitude of 10 micrometers, preload of 1 Newton, and force track of 125%. The DMA analysis is performed at a constant 25° C. temperature according to the following time/relative humidity (RH) profile: (i) 0% RH for 300 minutes (representing the dry state for storage modulus determination), (ii) 50% RH for 600 minutes, (iii) 90% RH for 600 minutes (representing the wet state for storage modulus determination), and (iv) 0% RH for 600 minutes.

The E' value (in MPa) is determined from the DMA curve according to standard DMA techniques at the end of each time segment with a constant RH value. Namely, the E' value at 0% RH (i.e., the dry-state storage modulus) is the value at the end of step (i), the E' value at 50% RH is the value at the end of step (ii), and the E' value at 90% RH (i.e., the wet-state storage modulus) is the value at the end of step (iii) in the specified time/relative humidity profile.

The material can be characterized by its dry-state storage modulus, its wet-state storage modulus, or the reduction in storage modulus between the dry-state and wet-state materials, where wet-state storage modulus is less than the dry-state storage modulus. This reduction in storage modulus can be listed as a difference between the dry-state storage modulus and the wet-state storage modulus, or as a percentage change relative to the dry-state storage modulus.

8. Glass Transition Temperature Test

This test measures the glass transition temperature ($T_g$) of the material for a sample, where the material is provided in neat form, such as with the Neat Film Sampling Procedure or the Neat Material Sampling Procedure, with a 10-milligram sample weight. The sample is measured in both a dry state and a wet state (i.e., after exposure to a humid environment as described herein).

The glass transition temperature is determined with DMA using a DMA analyzer commercially available under the tradename "Q2000 DMA ANALYZER" from TA Instruments, New Castle, Del., which is equipped with aluminum hermetic pans with pinhole lids, and the sample chamber is purged with 50 milliliters/minute of nitrogen gas during analysis. Samples in the dry state are prepared by holding at 0% RH until constant weight (less than 0.01% weight change over 120 minute period). Samples in the wet state are prepared by conditioning at a constant 25° C. according to the following time/relative humidity (RH) profile: (i) 250 minutes at 0% RH, (ii) 250 minutes at 50% RH, and (iii) 1,440 minutes at 90% RH. Step (iii) of the conditioning program can be terminated early if sample weight is measured during conditioning and is measured to be substantially constant within 0.05% during an interval of 100 minutes.

After the sample is prepared in either the dry or wet state, it is analyzed by DSC to provide a heat flow versus temperature curve. The DSC analysis is performed with the following time/temperature profile: (i) equilibrate at −90° C. for 2 minutes, (ii) ramp at +10° C./minute to 250° C., (iii) ramp at −50° C./minute to −90° C., and (iv) ramp at +10° C./minute to 250° C. The glass transition temperature value (in Celsius) is determined from the DSC curve according to standard DSC techniques.

9. Impact Energy Test

This test measures the ability of a material sample to shed soil under particular test conditions, where the sample is prepared using the Co-extruded Film Sampling Procedure or the Neat Film Sampling Procedure (to obtain a suitable sample surface area). Initially, the sample is fully immersed in a water bath maintained at 25° C. for 24 hours), and then removed from the bath and blotted with a cloth to remove surface water.

The saturated test sample is then adhered to an aluminum block model article having a 25.4-millimeter thickness and a 76.2 millimeters×76.2 millimeters surface area, using a room temperature-curing two-part epoxy adhesive commercially available under the tradename "LOCTITE 608" from Henkel, Dusseldorf, Germany. The adhesive is used to maintain the planarity of the soaked sample, which can curl when saturated.

Four polyurethane cleats, which are commercially available under the trade name "MARKWORT M12-EP" 0.5-inch (12.7 millimeter) tall cleats from Markwort Sporting Goods Company, St. Louis, Mo., are then screwed into the bottom of the block in a square pattern with a 1.56-inch (39.6-millimeter) pitch. As a control reference, four identical cleats are attached to an aluminum block model article without a material sample attached.

To clog the model article cleats, a bed of soil of about 75 millimeters in height is placed on top of a flat plastic plate. The soil is commercially available under the tradename "TIMBERLINE TOP SOIL", model 50051562, from Timberline (subsidiary of Old Castle, Inc., Atlanta, Ga.) and was sifted with a square mesh with a pore dimension of 1.5 millimeter on each side. The model article is then compressed into the soil under body weight and twisting motion until the cleats touch the plastic plate. The weight is removed from the model article, and the model article is then twisted by 90 degrees in the plane of the plate and then lifted vertically. If no soil clogs the model article, no further testing is conducted.

However, if soil does clog the model article, the soil is knocked loose by dropping a 25.4-millimeter diameter steel ball weighing 67 grams onto the top side of the model article (opposite of the test sample and clogged soil). The initial drop height is 152 millimeters (6 inches) above the model article. If the soil does not come loose, the ball drop height is increased by an additional 152 millimeters (6 inches) and dropped again. This procedure of increasing the ball drop height by 152 millimeter (6 inch) increments is repeated until the soil on the bottom of the article model is knocked loose.

This test is run 10 times per test sample. For each run, the ball drop height can be converted into unclogging impact energy by multiplying the ball drop height by the ball mass (67 grams) and the acceleration of gravity (9.8 meters/second). The unclogging impact energy in Joules equals the ball drop height in inches multiplied by 0.0167. The procedure is performed on both the model article with the material sample and a control model article without the material, and the relative ball drop height, and therefore relative impact energy, is determined as the ball drop height for the model article with the material sample divided by the control model article without the material. A result of zero for the relative ball drop height (or relative impact energy) indicates that no soil clogged to the model article initially when the model article was compressed into the test soil (i.e., in which case the ball drop and control model article portions of the test are omitted).

10. Soil Shearing Footwear Test

This test measures the mud shearing ability of an article of footwear, and does not require any sampling procedure. Initially, the article of the footwear (while still attached to the upper) is fully immersed in a water bath maintained at 25° C. for 20 minutes), and then removed from the bath and blotted with a cloth to remove surface water, and its initial weight is measured.

The footwear with the soaked article is then placed on a last (i.e., foot form) and fixed to a test apparatus commercially available under the tradename "INSTRON 8511" from Instron Corporation, Norwood, Mass. The footwear is then lowered so that the cleats are fully submerged in the soil, and then raised and lowered into the soil at an amplitude of 10 millimeters for ten repetitions at 1 Hertz. With the cleats submerged in the soil, the cleat is rotated 20 degrees in each direction ten times at 1 Hertz. The soil is commercially available under the tradename "TIMBERLINE TOP SOIL", model 50051562, from Timberline (subsidiary of Old Castle, Inc., Atlanta, Ga.), and the moisture content is adjusted so that the shear strength value is between 3 and 4 kilograms/cm$^2$ on a shear vane tester available from Test Mark Industries (East Palestine, Ohio.

After the test is complete, the footwear is carefully removed from the last and its post-test weight is measured. The difference between the post-test weight and the initial weight of the footwear, due to soil accumulation, is then determined.

Although the present disclosure has been described with reference to preferred aspects, workers skilled in the art will recognize that changes may be made in form and detail without departing from the spirit and scope of the disclosure.

The present disclosure can be described in accordance with the following numbered clauses.

Clause 1. A component of an article of footwear, apparel, or sporting equipment, the component comprising:

a first surface of the component configured to be externally-facing when the component is present in a finished article; and a second surface of the component opposing the first surface;

wherein the component comprises a material defining at least a portion of the first surface, and the material compositionally comprises a hydrogel.

Clause 2. A component of an article of footwear, the component comprising:

a first surface of the component configured to be externally-facing when the component is present in a finished article of footwear; and a second surface of the component opposing the first surface;

wherein the component comprises a material defining at least a portion of the first surface, and the material compositionally comprises a hydrogel.

Clause 3. A component for an article of apparel, the component comprising:

a first surface of the component configured to be externally-facing when the component is present in a finished article of apparel; and a second surface of the component opposing the first surface;

wherein the component comprises a material defining at least a portion of the first surface of the component, and the material compositionally comprises a polymeric hydrogel.

Clause 4. A component for an article of sporting equipment, the component comprising:

a first surface of the component configured to be externally-facing when the component is present in a finished article of sporting equipment; and a second surface of the component opposing the first surface;

wherein the component comprises a material defining at least a portion of the first surface of the component, and the material compositionally comprises a polymeric hydrogel.

Clause 5. The component of clause for 2, wherein the component is a traction element of an article of footwear.

Clause 6. The component of clause 5, wherein the fraction element is a traction element for golf footwear.

Clause 7. The component of clause 5 or 6, wherein the traction element has a generally flat central base region and a plurality of shafts arranged around a perimeter of the central base region.

Clause 8. The component of any of clauses 1-3, wherein the material comprises a polymeric hydrogel is present in the form of a filament used to form at least a portion of a non-woven textile; or in the form of a yarn used to form at least a portion of a woven textile, a knit textile, or a braided textile.

Clause 9. The component of clause 8, wherein the material is present in the form of a filament used to form at least a portion of a non-woven upper for an article of footwear; or in the form of a yarn used to form at least a portion of a woven upper, a knit upper, or a braided upper for an article of footwear.

Clause 10. The component of clause 9, wherein the material is present in the form of a yarn used to knit at least a portion of a knit upper.

Clause 11. The component of any of clauses 1-3, wherein the component is formed of a textile.

Clause 12. The component of clause 11, wherein the textile component is a woven, knit or braided component.

Clause 13. The component of clause 11, wherein the textile component is a unitary knit or braided component.

Clause 14. The component of any of clauses 1-13, wherein the material is present in the form of a film.

Clause 15. The component of any of clauses 1-14, wherein the material has a water uptake capacity at 1 hour greater than 100% by weight, as characterized by the Water Uptake Capacity Test with the Footwear Sampling Procedure when the component is a component of an article of footwear, with the Apparel Sampling Procedure when the component is a component of an article of apparel, or with the Sporting Equipment Sampling Procedure when the component is a component of an article of sporting equipment.

Clause 16. The component of any of clauses 1-15, wherein the material has a water uptake capacity at 24 hours greater than 40% by weight, as characterized by the Water Uptake Capacity Test with the Footwear Sampling Procedure when the component is a component of an article of footwear, with the Apparel Sampling Procedure when the component is a component of an article of apparel, or with the Sporting Equipment Sampling Procedure when the component is a component of an article of sporting equipment.

Clause 17. The component of any of clauses 1-16, wherein the material has a water uptake rate of at least 20 $g/(m^2 \times min^{0.5})$, as characterized by the Water Uptake Rate Test with the Footwear Sampling Procedure when the component is a component of an article of footwear, with the Apparel Sampling Procedure when the component is a component of an article of apparel, or with the Sporting Equipment Sampling Procedure when the component is a component of an article of sporting equipment.

Clause 18. The component of any of clauses 1-17, wherein the material has a swell thickness increase at 1 hour of greater than 120%, as characterized by the Swell Capacity Test with the Footwear Sampling Procedure when the component is a component of an article of footwear, with the Apparel Sampling Procedure when the component is a component of an article of apparel, or with the Sporting Equipment Sampling Procedure when the component is a component of an article of sporting equipment.

Clause 19. The component of any of clauses 1-18, wherein the material has a wet-state glass transition temperature and a dry-state glass transition temperature, each as characterized by the Glass Transition Temperature Test with the Neat Material Sampling Process, and wherein the wet-state glass transition temperature is at least 6° C. less than the dry-state glass transition temperature.

Clause 20. The component of any of clauses 1-19, wherein the material has a wet-state storage modulus and a dry-state storage modulus, each as characterized by the Storage Modulus Test with the Neat Material Sampling Procedure, and wherein the wet-state storage modulus is at least 25 MPa lower than the dry-state storage modulus of the material.

Clause 21. The component of any of clauses 1-20, wherein the first surface of the component has a wet-state contact angle less than 80° as characterized by the Contact Angle Test with the Footwear Sampling Procedure when the component is a component of an article of footwear, with the Apparel Sampling Procedure when the component is a component of an article of apparel, or with the Sporting Equipment Sampling Procedure when the component is a component of an article of sporting equipment.

Clause 22. The component of any of clauses 1-21, wherein the hydrogel of the material comprises a crosslinked polymer network.

Clause 23. The component of clause 22, wherein the crosslinked polymer network is physically crosslinked.

Clause 24. The component of any of clauses 1-23, wherein the material comprises a polymeric network including one or more chains of a polyurethane, one or more chains of a polyamide homopolymer, one or more chains of a polyamide copolymer, and combinations thereof.

Clause 25. The component of any of clauses 1-24, wherein the material comprises a polymeric network including one or more chains of a polyurethane.

Clause 26. The component of any of clauses 1-25, wherein the material comprises a polymeric network including one or more chains of a polyamide homopolymer.

Clause 27. The component of any of clauses 1-26, wherein the material comprises a polymeric network including one or more chains of a polyamide copolymer.

Clause 28. The component of any of clauses 1-27, wherein the material defining at least a portion of the first surface of the component has a dry-state thickness ranging from 0.1 millimeters to 5 millimeters as characterized with the Footwear Sampling Procedure when the component is a component of an article of footwear, with the Apparel Sampling Procedure when the component is a component of an article of apparel, or with the Sporting Equipment Sampling Procedure when the component is a component of an article of sporting equipment.

Clause 29. The component of any of clauses 1-28, wherein the material compositionally comprises a crosslinked polymeric network that has a plurality of copolymer chains.

Clause 30. The component of clause 29, wherein the plurality of copolymer chains of the crosslinked polymeric network comprise one or more hard segments physically crosslinked to other hard segments of the copolymer chains; and one or more hydrophilic soft segments covalently bonded to the hard segments.

Clause 31. The component of clause 30, wherein the one or more hydrophilic soft segments of the plurality of copolymer chains are present in the copolymer chains at a ratio ranging from 20:1 to 110:1 by weight relative to the one or more hard segments.

Clause 32. The component of any of clauses 1-31, wherein the hydrogel of the material compositionally comprises semi-crystalline regions and amorphous regions.

Clause 33. The component of clause 32, wherein the amorphous regions of the polymeric hydrogel are covalently bonded to the semi-crystalline regions with carbamate linkages.

Clause 34. The component of clause 32 or 33, wherein the semi-crystalline regions are present in the polymeric hydrogel at a ratio of at least 20:1 by weight relative to the semi-crystalline regions.

Clause 35. An article of footwear, apparel or sporting equipment comprising the component of any of clauses 1-34, wherein the article comprises a second component, and said components are secured to each other such that the first surface of the component is externally-facing on the finished article.

Clause 36. The article of clause 35, wherein the second component is an outsole of an article of footwear, and the outsole also comprises the material on a side of the outsole configured to be externally-facing when the component is present in the finished article of footwear.

Clause 37. The article of clause 35 or 36, wherein the component of the article prevents or reduces soil accumulation on the component such that the article retains at least 10% less soil by weight as compared to a second article which is identical to the article except that the second article is free of the material.

Clause 38. The article of any of clauses 35-37, wherein the material reduces a force of adhesion of soil accumulated on the component such that at least 10% less force is required to dislodge the accumulated soil from the component as compared to a second article which is identical to the article except that the second article is substantially free of the material.

Clause 39. A method of manufacturing an article of footwear, apparel or sporting equipment, the method comprising:

providing a component of an article of footwear, apparel or sporting equipment, the component comprising a material defining at least a portion of an externally-facing surface of the article, the material compositionally comprising a hydrogel;

providing a second component; and securing said components to each other such that the first surface of the component is externally-facing on the finished article.

Clause 40. The method of clause 39, wherein the component comprises a component in accordance with any of clauses 1-34.

Clause 41. The method of clause 39 or 40, wherein securing said components comprises securing the component to the second component.

Clause 42. The method of any of clauses 39-41, wherein securing said components to each other comprises forming the finished article.

Clause 43. Use of a material compositionally comprising a hydrogel to prevent or reduce soil accumulation on an externally-facing surface of an article of footwear, apparel or sporting equipment, which externally-facing surface comprises the material, by providing the material on the externally-facing surface of the article, wherein the article retains at least 10% less soil by weight as compared to a second article which is identical except that the externally-facing surface of the second article is free of the material.

Clause 44. The use of clause 43, wherein the article is an article in accordance with any of clauses 35-38, or the material is a material in accordance with any of clauses 8, 9, 14-20, or 22-34.

Clause 45. Use of a material compositionally comprising a hydrogel to prevent or reduce soil accumulation on a first surface of article of footwear, apparel or sporting equipment, which first surface comprises the material, by providing the material on the first surface of the article, wherein the article optionally retains at least 10% less soil by weight as compared to a second article which is identical except that the first surface of the second outsole is substantially free of the material.

Clause 46. The use of clause 45, wherein the article is an article according to clause 35-38 and/or wherein the material is as further defined in any one of clauses 8, 9, 14-20, or 22-34.

What is claimed is:

1. An article of footwear having a component comprising:

a first surface of the component configured to be externally-facing and ground contacting; and a second surface of the component opposing the first surface;

wherein the component comprises a material defining at least a portion of the first surface, and the material compositionally comprises a hydrogel, wherein the material comprises a polymeric network including one or more chains of a polyurethane, one or more chains of a polyamide homopolymer, and combinations thereof, wherein the material is present in the form of a filament that is at least a portion of a non-woven textile; or in the form of a yarn that is at least a portion of a woven textile, a knit textile, or a braided textile; or in the form of a film.

2. The article of claim 1, wherein the material has a water uptake capacity at 1 hour greater than 100% by weight, as characterized by the Water Uptake Capacity Test with the Footwear Sampling Procedure when the component is a component of an article of footwear.

3. The article of claim 1, wherein the material has a water uptake capacity at 24 hours greater than 40% by weight, as characterized by the Water Uptake Capacity Test with the Footwear Sampling Procedure when the component is a component of an article of footwear.

4. The article of claim 1, wherein the material has a water uptake rate of at least 20 $g/(m^2 \times min^{0.5})$, as characterized by the Water Uptake Rate Test with the Footwear Sampling Procedure when the component is a component of an article of footwear.

5. The article of claim 1, wherein the material has a swell thickness increase at 1 hour of greater than 120%, as characterized by the Swell Capacity Test with the Footwear Sampling Procedure when the component is a component of an article of footwear.

6. The article of claim 1, wherein the material has a wet-state glass transition temperature and a dry-state glass transition temperature, each as characterized by the Glass Transition Temperature Test with the Neat Material Sampling Process, and wherein the wet-state glass transition temperature is at least 6° C. less than the dry-state glass transition temperature.

7. The article of claim 1, wherein the material has a wet-state storage modulus and a dry-state storage modulus, each as characterized by the Storage Modulus Test with the Neat Material Sampling Procedure, and wherein the wet-state storage modulus is at least 25 MPa lower than the dry-state storage modulus of the material.

8. The article of claim 1, wherein the first surface of the component has a wet-state contact angle less than 80° as characterized by the Contact Angle Test with the Footwear Sampling Procedure when the component is a component of an article of footwear.

9. The article of claim 1, wherein the hydrogel of the material comprises a crosslinked polymer network.

10. The article of claim 9, wherein the crosslinked polymeric network is a physically crosslinked polymer network.

11. The article of claim 1, wherein the material defining at least a portion of the first surface of the component has a dry-state thickness ranging from 0.1 millimeters to 5 millimeters as characterized with the Footwear Sampling Procedure when the component is a component of an article of footwear.

12. The article of claim 9, wherein the crosslinked polymeric network includes carbamate linkages.

13. An article of footwear having a component comprising:

a first surface of the component configured to be on the bottom of the article of footwear, ground contacting, and externally-facing; and a second surface of the component opposing the first surface;

wherein the component comprises a material defining at least a portion of the first surface, and the material compositionally comprises a hydrogel, wherein the hydrogel of the material comprises a crosslinked polymer network, wherein the hydrogel of the material compositionally comprises semi-crystalline regions and amorphous regions, wherein the material is present in the form of a filament that is at least a portion of a non-woven textile; or in the form of a yarn that is at least a portion of a woven textile, a knit textile, or a braided textile; or in the form of a film.

14. The article of claim 13, wherein the crosslinked polymeric network is a physically crosslinked polymer network.

15. The article of claim 13, wherein the amorphous regions are present in the hydrogel at a ratio of at least 20:1 by weight relative to the semi-crystalline regions.

16. The article of claim 13, wherein the crosslinked polymeric network includes one or more chains of a polyurethane, one or more chains of a polyamide homopolymer, and combinations thereof.

17. The article of claim 13, wherein the material comprises a polymeric network including one or more chains of a polyurethane, one or more chains of a polyamide homopolymer, and combinations thereof.

18. An article of footwear having a component comprising:

a first surface of the component configured to be externally-facing and ground contacting; and a second surface of the component opposing the first surface;

wherein the component comprises a material defining at least a portion of the first surface, and the material compositionally comprises a hydrogel, wherein the material is present in the form of a filament that is at least a portion of a non-woven textile; or in the form of a yarn that is at least a portion of a woven textile, a knit textile, or a braided textile; or in the form of a film, wherein the hydrogel of the material compositionally comprises semi-crystalline regions and amorphous regions.

19. The article of claim 18, wherein the amorphous regions are present in the hydrogel at a ratio of at least 20:1 by weight relative to the semi-crystalline regions.

20. The article of claim 18, wherein the material has a water uptake capacity at 1 hour greater than 100% by weight, as characterized by the Water Uptake Capacity Test with the Footwear Sampling Procedure when the component is a component of an article of footwear.

* * * * *